US010280579B2

(12) United States Patent
Rines et al.

(10) Patent No.: US 10,280,579 B2
(45) Date of Patent: May 7, 2019

(54) AUTOMATIC GATE OPERATION AND SYSTEM STATUS INDICATION FOR MARINE BARRIERS AND GATE SYSTEMS

(71) Applicant: HALO Maritime Defense Systems, Inc, Newton, NH (US)

(72) Inventors: Eric H. Rines, Manchester, NH (US); Judson DeCew, Rochester, NH (US); Brendan Gray, Newton, NH (US); Eric G. Johnson, Danvers, MA (US)

(73) Assignee: HALO MARITIME DEFENSE SYSTEMS, INC., Newton, NH (US)

( * ) Notice: Subject to any disclaimer, the term of this patent is extended or adjusted under 35 U.S.C. 154(b) by 0 days.

(21) Appl. No.: 15/920,854

(22) Filed: Mar. 14, 2018

(65) Prior Publication Data

US 2018/0266068 A1 Sep. 20, 2018

Related U.S. Application Data

(60) Provisional application No. 62/471,754, filed on Mar. 15, 2017.

(51) Int. Cl.

| | |
|---|---|
| ***E02B 7/50*** | (2006.01) |
| ***B63G 9/04*** | (2006.01) |
| ***F41H 11/05*** | (2006.01) |
| *E02B 7/38* | (2006.01) |

(52) U.S. Cl.

CPC ..... *E02B 7/50* (2013.01); *B63G 9/04* (2013.01); *F41H 11/05* (2013.01); *E02B 7/38* (2013.01)

(58) Field of Classification Search

CPC combination set(s) only.
See application file for complete search history.

(56) References Cited

U.S. PATENT DOCUMENTS

| | | | |
|---|---|---|---|
| 3,410,246 | A | 11/1968 | Lowe |
| 4,864,903 | A | 9/1989 | Bickford et al. |
| 4,921,219 | A | 5/1990 | Ottemann et al. |
| 5,088,859 | A | 2/1992 | Devlin |
| 6,681,709 | B1 | 1/2004 | Nixon et al. |
| 7,401,565 | B2 | 7/2008 | Nixon et al. |

(Continued)

FOREIGN PATENT DOCUMENTS

JP 2015081500 A 4/2015

OTHER PUBLICATIONS

International Search Report and Written Opinion dated Jun. 6, 2018 for related International Application No. PCT/US2018/022351.

*Primary Examiner* — Kyle Armstrong
(74) *Attorney, Agent, or Firm* — Miles & Stockbridge P.C.

(57) ABSTRACT

A system is provided for automatic operation and status indication of a marine barrier gate. Embodiments include a system having a buoyant barrier gate that is movable between a closed position and an open position. An actuator moves the gate between the open and closed positions, and a sensor is operably connected to the actuator to generate data relating to a position of the barrier gate between the open and closed positions. A processor receives the data from the sensor and processes the data to move the gate between the open and closed positions, and detect the position of the gate. A human-machine interface is operably connected to the processor for communicating the detected position of the barrier gate to a user.

28 Claims, 16 Drawing Sheets

(56) References Cited

U.S. PATENT DOCUMENTS

| | | | | |
|---|---|---|---|---|
| RE40,616 | E | 1/2009 | Nixon et al. | |
| 8,920,075 | B2 | 12/2014 | Bishop | |
| 9,863,109 | B2 | 1/2018 | DeCew et al. | |
| 2002/0134178 | A1 | 9/2002 | Knight et al. | |
| 2006/0071116 | A1 | 4/2006 | Quenneville et al. | |
| 2008/0105184 | A1 | 5/2008 | Nixon et al. | |
| 2010/0116191 | A1 | 5/2010 | Holmberg et al. | |
| 2016/0134379 | A1* | 5/2016 | Tehranchi | H04B 17/00 455/63.1 |
| 2016/0244927 | A1 | 8/2016 | Adler | |
| 2016/0289907 | A1* | 10/2016 | DeCew | B66D 1/60 |
| 2016/0366534 | A1* | 12/2016 | Griesmann | H04W 8/22 |

* cited by examiner

AUTOMATIC GATE OPERATION AND SYSTEM STATUS INDICATION FOR MARINE BARRIERS AND GATE SYSTEMS

RELATED APPLICATIONS

The present application claims priority to U.S. Provisional Application No. 62/471,754, entitled "Automatic Gate Operation and System Status Indication for Marine Barriers and Gate Systems," filed Mar. 15, 2017, which is incorporated herein by reference in its entirety.

FIELD

The present subject matter relates to marine barriers and movable gates. The present disclosure has particular applicability to automatic gate systems and methods. Embodiments include such systems and methods which provide indications of the system status to system and vessel operators, to allow for safe transit of waterways secured by those marine barriers and gates.

BACKGROUND

Structures for use on both land and/or water as security barrier systems have been previously developed. Such structures generally intend to stop intruding objects, and range from thick, solid walls blocking the object's progress to secured areas, or disabling the propelling mechanism of the object. These structures commonly exhibit noticeable shortcomings. First, these structures are often cumbersome and time-consuming to install and erect as and where desired. Second, they are difficult, or even impossible, to maintain and/or repair after they have sustained the impact of an intruding object. Third, they are often not adaptable to different needs and conditions. Fourth, the barriers and/or gates are operated manually ("man in the loop") or employ a tug/service vessel boat, do not have any indications for barrier/gate operators and/or vessel operators as to the status of the gate (i.e., opened/closed), when/if to stand by, when/if it is safe to enter the gate, and when/if a gate is securely closed or open.

In addition, conventional barriers such as disclosed in U.S. Pat. RE40,616; U.S. Pat. Nos. 7,401,565; and 6,681,709; and US Pub. 2008/0105184 need to have a person/vessel on site to open and close the barrier, and/or have personnel on site to verify if the barrier has been secured properly, opened, tampered with, etc. These systems have no notification ability, or ability to signal to operators the gate is securely closed.

An improved marine barrier is disclosed in U.S. Pat. No. 8,920,075, which is hereby incorporated by reference in its entirety. Referring now to FIGS. 1a-1b, a marine barrier 400 of the '075 patent includes two continuous pleated rows 401, 402 of first and second respective pluralities of buoyant panels 110, to form a diamond-shaped barrier. A plurality of outboard hinges 120 and a plurality of inboard hinges 420 elastically connect opposing sides of adjacent panels 110 to form the included angle "A" therebetween, to form two continuous pleated rows 401, 402, such that the hinges 120, 420 are arranged in first, second, and third substantially parallel rows 410a-*c*.

The marine barrier of FIGS. 1a-1b is a vast improvement over previous barriers, at least in that it has the unique ability to collapse along its length. However, it does not have a control system to open and close the gate automatically. Also, the system is not optimized to allow for the ability to monitor the system status, including the status of any latches or other critical information, as well as notify vessel operators when it is safe to travel.

There exists a need for a marine barrier to have a control system that automatically opens and closes the gate, the ability to notify operators and navigating vessels to the status of the gate (i.e., if the gate is open, closed, partially open, or in progress of one of those processes), if the system is securely fastened, and when it is safe for vessels to transit the protected waterway.

Present indication methods disadvantageously employ personnel located locally (on site), and the use of marine radios or the equivalent to notify vessels whether the gate is safe to pass through. Systems and technologies exist that indicate; for example, safe travel for vessels when entering and existing structures such as canal locks, and navigation lights that indicate when vessels can pass through a drawbridge. However, these systems employ personnel at the canal locks or bridges that control the navigation lights and thus the flow of traffic. No technology currently employed allows the operators to know if a gate is opened or closed, if a latch is secure, or any other method of indicating a secure border except as communicated by a person on site inspecting the system.

There exists a need for a marine barrier with the ability to indicate to gate operators located remotely, in close to real time, the status of any and all latching mechanisms, and whether it is safe for marine traffic to enter the protected waterway.

SUMMARY

The present disclosure provides marine security barrier/gate control systems and indication systems for operators and security personnel that address the aforementioned needs.

One or more embodiments can include a marine barrier gate system comprising a marine gate including a buoyant barrier gate, wherein when the barrier gate is floating in a body of water, it is movable from a closed position where the barrier gate extends from a substantially stationary first attachment point to a substantially stationary second attachment point remote from the first attachment point, to an open position where the barrier gate extends from the first attachment point to a location other than the second attachment point. The first attachment point is attached to a first end of the barrier gate. The system further includes an actuator for moving the barrier gate between the open and closed positions, and a sensor operably connected to the actuator to generate data relating to a position of the barrier gate between the open and closed positions. The system has a controller with a processor for receiving the data from the sensor and processing the data to move the barrier gate between the open and closed positions, and detecting the position of the barrier gate. A human-machine interface is operably connected to the processor for communicating the detected position of the barrier gate to a user.

In certain embodiments, the barrier gate has a variable length, the closed position is a fully expanded position where the barrier gate extends from the first attachment point to the second attachment point, and the open position is a retracted position where the barrier gate extends from the first attachment point to a location between the first and second attachment points. The actuator includes an opening winch and a closing winch having opening and closing lines respectively, the opening and closing winches located at the first and second attachment points respectively, the opening and closing lines attached proximal to a free end of the barrier gate opposite the first end of the barrier gate, for moving the barrier gate by motion of the respective lines. The sensor includes a first encoder operably attached to a first rotating hub that rotates with the motion of the opening line, for counting rotations of the first hub to generate first encoder data; and the sensor further includes a second encoder operably attached to a second rotating hub that rotates with the motion of the closing line, for counting rotations of the second hub to generate second encoder data. The processor is for receiving and processing the first and second encoder data to detect the position of the barrier gate.

Embodiments can further comprise an end position sensor for generating a signal when a free end of the barrier gate opposite the first end of the barrier gate is proximal to the second attachment point, a closing line extendible from the second attachment point, and a closing line sensor mounted below the surface of the body of water for generating a signal when the closing line is proximal to the closing line sensor. The processor is for receiving the signals from the end position sensor and the closing line sensor. The processor is also for detecting that the gate is in a closed and latched position when the end position sensor senses the free end of the gate is proximal to the second attachment point; and for detecting that the gate is in an open position and the closing line is extended from the second attachment point when the end position sensor does not sense the free end of the gate and the closing line sensor senses the closing line.

In further embodiments, the controller includes a memory, and the processor is for calibrating the system by moving the gate to the open position based on the first and second encoder data or based on input from a user, storing the first and second encoder data as open position data in the memory, moving the gate to the closed position based on updated first and second encoder data corresponding to when the gate is in the closed position or based on input from the user, and storing the updated first and second encoder data as closed position data in the memory.

In one or more embodiments, the opening and closing winches each have a load measurement device to measure tension in the opening and closing lines, respectively, and the processor is for receiving data from the load measurement devices and processing the data to control a speed of the gate and the tension in each of the opening and closing lines.

In certain embodiments, the first and second encoder data from the winch encoders indicate an amount of opening and closing line, respectively, payed off the opening and closing winches. The processor is for causing the human-machine interface to inform the user when the first or second encoder data indicates the amount of line payed off the opening or closing winch differs from a predetermined set point, and/or for causing the gate to stop moving, and/or for activating a warning light. The processor is also for causing the human-machine interface to inform the user when the tension in one or more of the opening and closing cables exceeds a predetermined set point, and/or for causing the gate to stop moving, and/or for activating a warning light.

Objects and advantages of embodiments of the disclosed subject matter will become apparent from the following description when considered in conjunction with the accompanying drawings.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DETAILED DESCRIPTION

It should be understood that the principles described herein are not limited in application to the details of construction or the arrangement of components set forth in the following description or illustrated in the following drawings. The principles can be embodied in other embodiments and can be practiced or carried out in various ways. Also, it is to be understood that the phraseology and terminology used herein is for the purpose of description and should not be regarded as limiting.

Disclosed herein are marine barrier and gate systems incorporating automatic operation, advanced system status indication technology and techniques that simplify and improve existing gate operations, improve reliability, and allow the operators to better understand the location of the gate at all times, indicate to operators if it is safe to transit the protected waterway, and alert operators in the event the unauthorized access or gate movement is occurring.

General Description of Marine Gates Usable With the Disclosed Systems

Figure 1A:
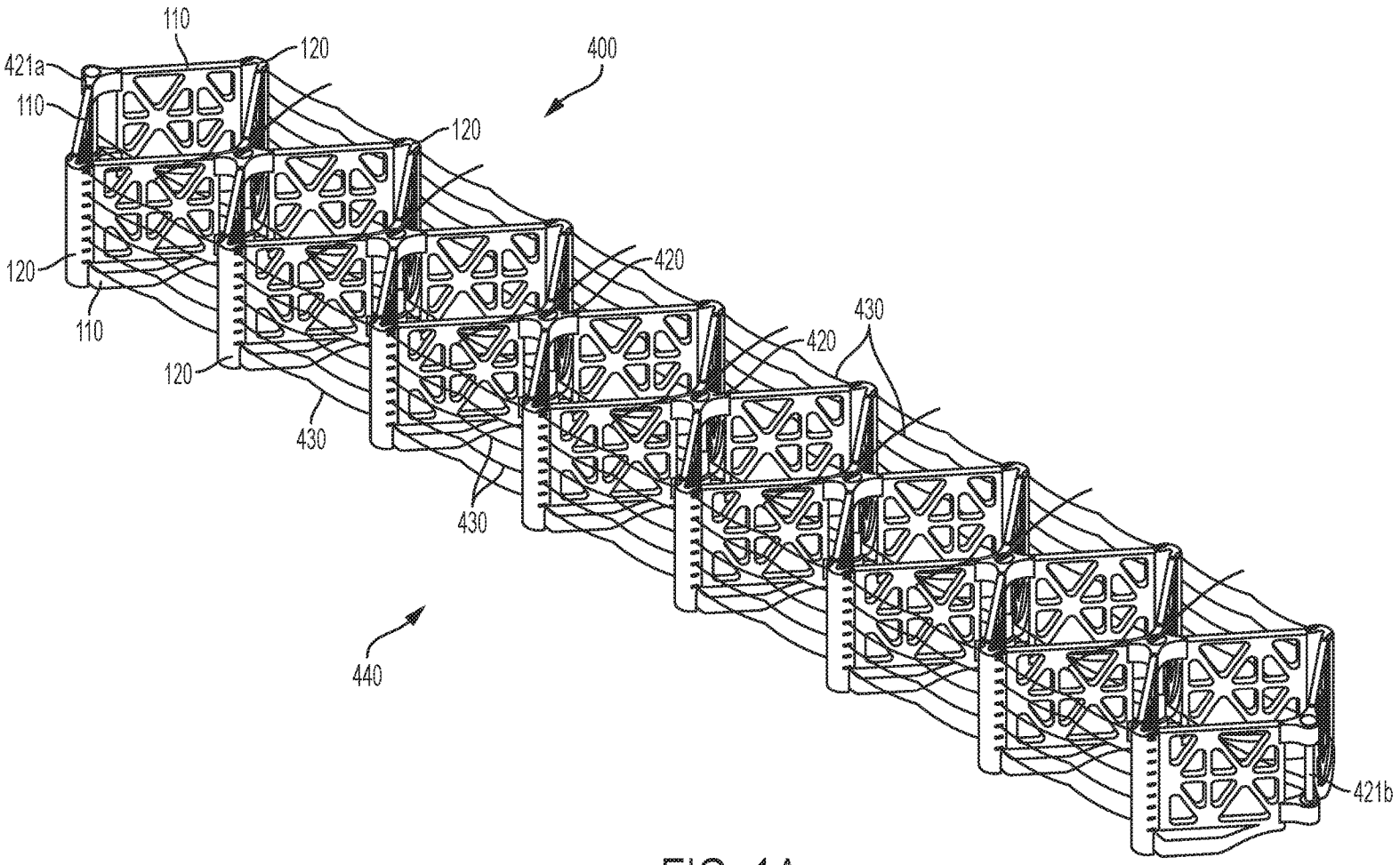
FIG. 1A PRIOR ART
FIGS. 1A and 1B are a perspective view and a top view, respectively, of a marine barrier that collapses along its length that is usable with the present disclosure.
Figure 1B:
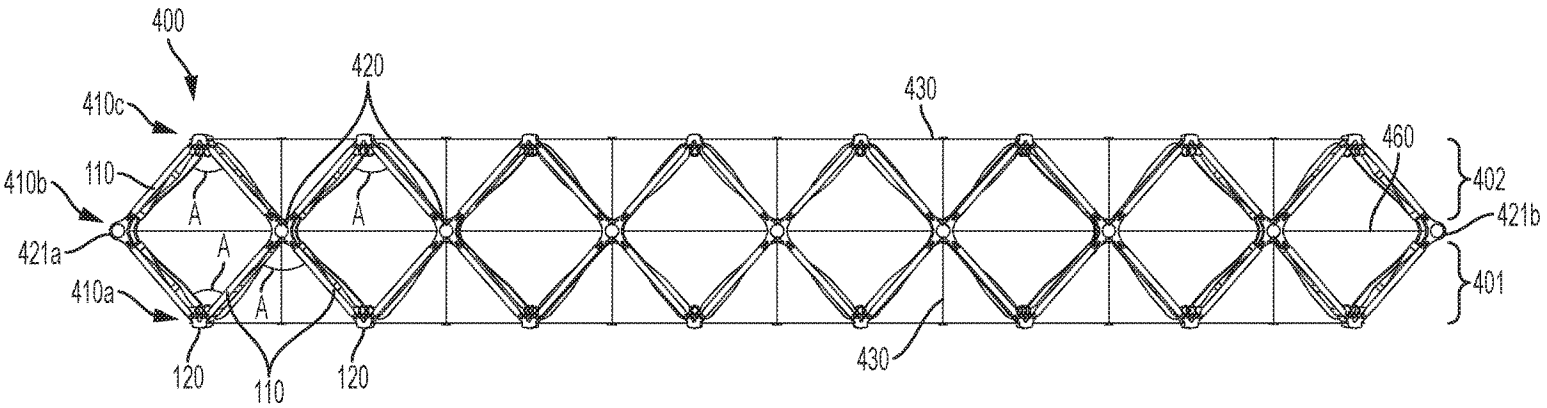
FIG. 1B PRIOR ART
Figure 2A:
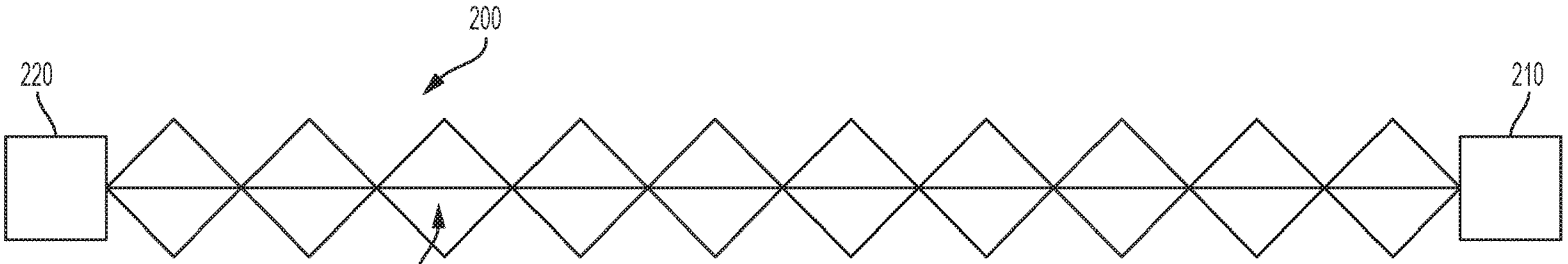
FIGS. 2*a-c* are top views of a marine barrier gate usable with the present disclosure that collapses along its length, in its fully closed, fully opened, and partially opened position, respectively.
Figure 2B:
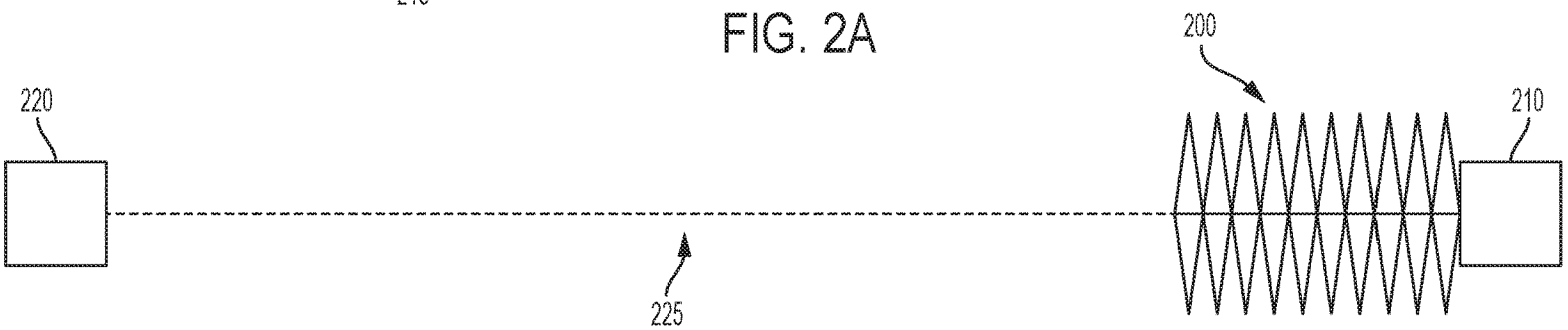
Figure 2C:
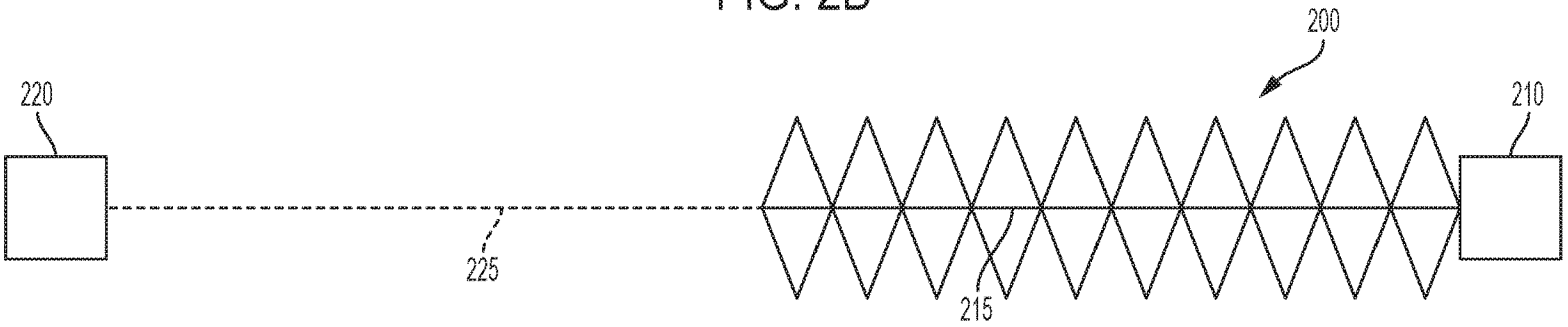
Figure 3A:
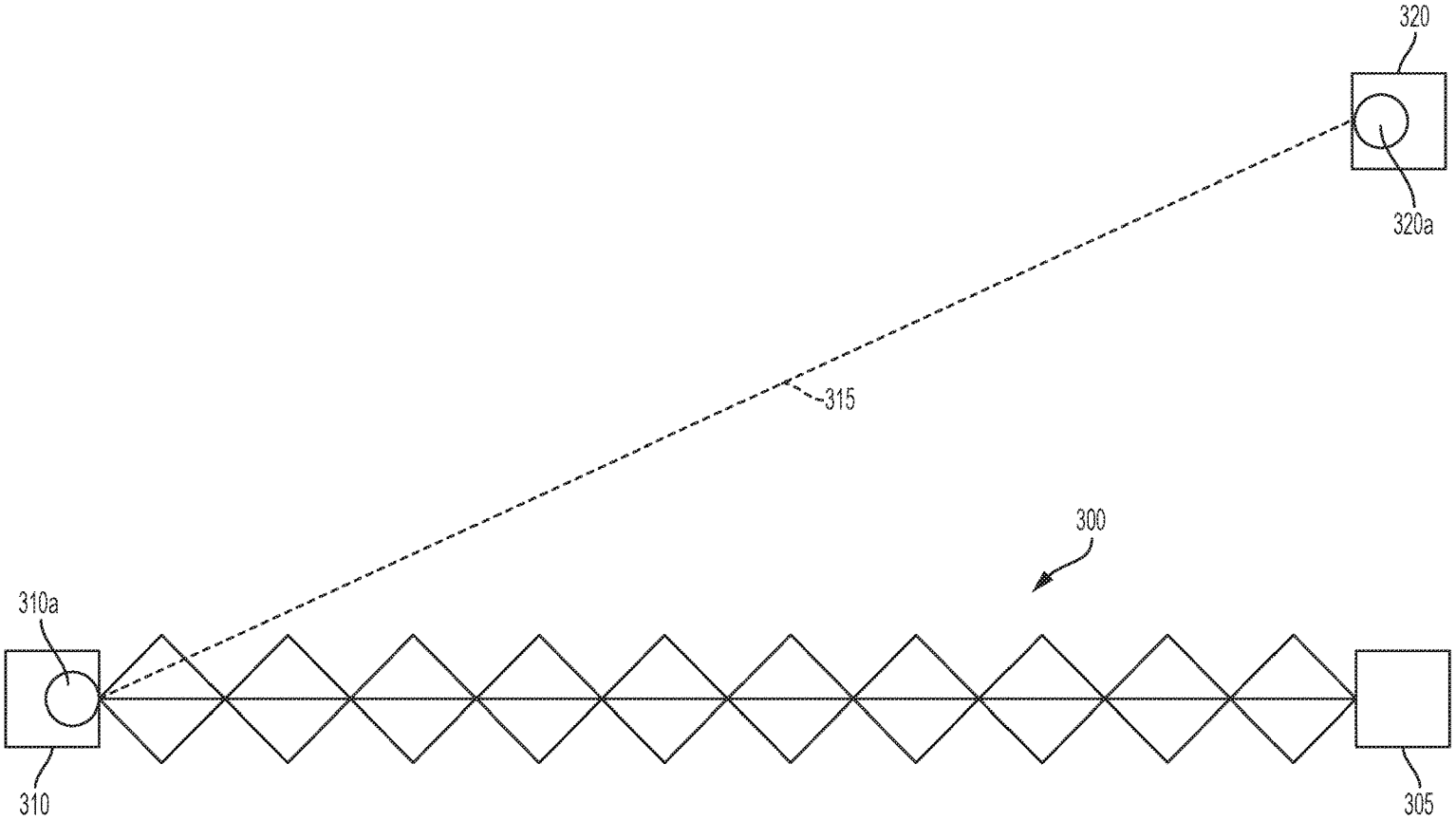
FIGS. 3*a-b* are top views of a marine barrier gate usable with the present disclosure that is swung open and closed, in its closed position and opened position, respectively.
Figure 3B:
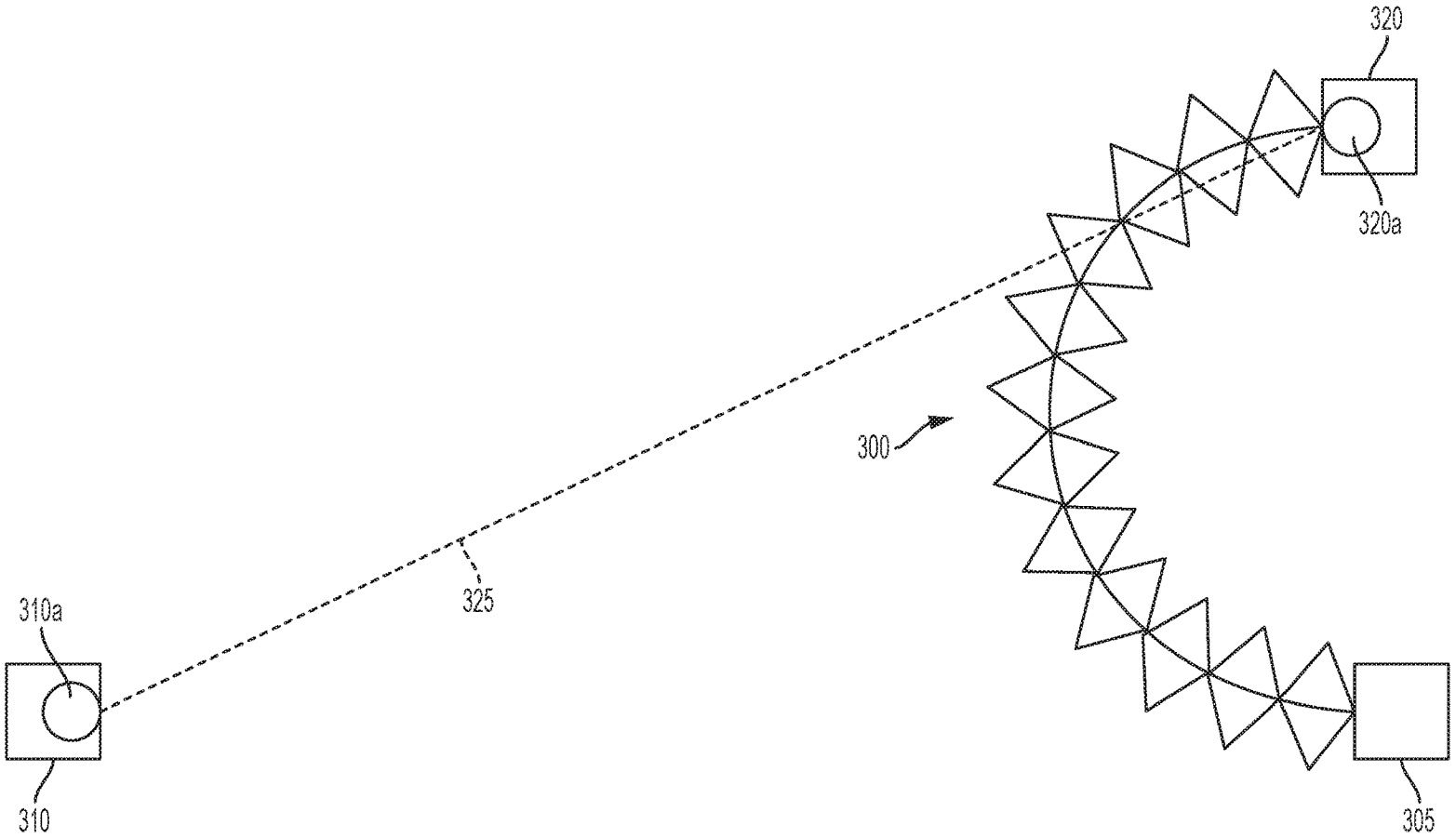

The disclosed systems are usable with a marine gate that is a floating structure to block entry to a port or controlled area, as illustrated in FIGS. 1*a*-3*b*. The disclosed systems, structures and techniques are usable with gates, such as the type shown in FIGS. 1*a*-1*b* and FIGS. 2*a*-3*c*, which are flexible and can collapse along their length. In certain other embodiments, the gate is rigid, semi-rigid or segmented and must be swung out of the way to provide vessel access, as shown in FIGS. 3*a*-*b*. The gate in FIGS. 3*a*-*b* can also be similar to the gate of FIGS. 1*a*-1*b* or FIGS. 2*a*-*c*.

Referring now to FIGS. 2*a*-*b*, an exemplary variable-length flexible barrier gate 200 usable with the disclosed systems will be described. Gate 200 can collapse along its length, and includes an opening winch 210 connected to gate 200 via an opening line 215, and a closing winch 220 connected to gate 200 via a closing line 225. When gate 200 is opening, the opening winch 210 draws in the opening line 215, while the closing winch 220 pays out the closing line 225. After the gate 200 is moved to the open position as shown in FIG. 2*b*, closing winch 220 continue to pay out closing line 225 until it rests on the seafloor, to allow vessels to pass through. The process is reversed to close the gate 200.

In certain embodiments, the gate 200 has open, partially open, and closed positions. The partially open position is shown in FIG. 2*c*. In such embodiments gate 200 traverses along its length between a closed position (FIG. 2*a*), a partially open position (FIG. 2*c*), and a fully open position (FIG. 2*b*). After the gate 200 is moved to the desired partially or fully open position shown in FIG. 2*b* or FIG. 2*c*, closing winch 220 continues to pay out closing line 225 until it rests on the seafloor, to allow vessels to pass through.

In further exemplary embodiments shown in FIGS. 3*a*-*b*, a variable-length gate is swung into its open, partially open, and closed positions. Gate 300 is semi-rigid, and when closed extends between a first end connection 305 and a second end connection 310, as shown in FIG. 3*a*. When it is fully open, gate 300 extends between first end connection 305 and a secondary end connection 320, as shown in FIG. 3*b*. An opening winch 320*a* is connected to gate 300 via an opening line 315, and a closing winch 310*a* is connected to gate 300 via a closing line 325. When gate 300 is opening, the opening winch 320*a* draws in the opening line 415, while the closing winch 310*a* pays out the closing line 325. After the gate 300 is moved to the fully open position as shown in FIG. 3*b* (or to a partially open position), closing winch 310*a* continues to pay out closing line 325 until it rests on the seafloor, to allow vessels to pass through. The process is reversed to close the gate 300.

The disclosed gate system's actuator is a conventional winch, which is connected to the barrier via a closing or opening line (e.g., a cable or rope). In certain embodiments, each winch is driven by a hydraulic motor, or through a transmission mechanism attached to a hydraulic motor. Alternatively, the winch(es) are driven by an electric motor, or through a transmission mechanism attached to an electric motor. The transmission mechanism may be a gearbox, chain-drive, belt-drive, or combination of any or all of these. Examples of commercially available winches usable with the disclosed gate include a hydraulic winch such as the Pullmaster H30 available from TWG of Tulsa, Okla., and an electric winch such as the Model HBP power winch available from Them Inc. of Winona, Minn.

Automatic Gate Operation and Monitoring

The disclosed marine gate systems monitor and report the position of a gate during operation, monitor and report the status of its end connections, and indicate to the operator(s) whether a gate is opened, closed, or securely fastened. Embodiments generally include a system of sensors on and off the barrier for indicating the position of the gate between its open and closed position at any point during the opening/closing sequences, thereby providing operators critical real-time information on the position of the gate during its operation. The disclosed gate can thus be operated automatically both from a local position (e.g., by a person adjacent to the gate) and a remote position (e.g., from a control room or port operations building).

Figure 4:
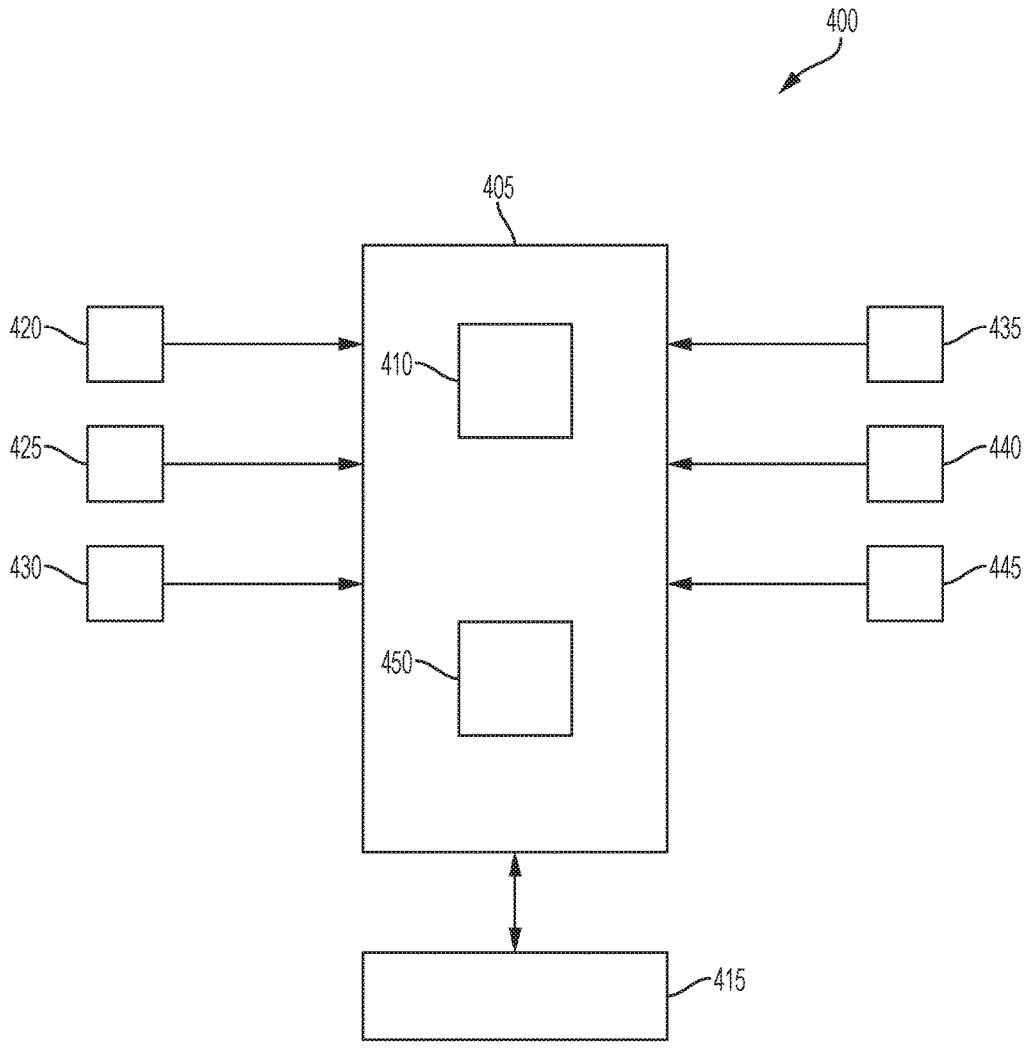
FIG. 4 is a block diagram of a marine barrier gate system according to the present disclosure.

FIG. 4 shows a general system overview of the disclosed marine barrier gate systems. A disclosed system 400 comprises a conventional controller 405 having a processor 410 that performs the processing and calculating functions described herein, and a memory 450. Controller 405 can comprise, for example, a process automation controller (PAC) with dedicated control hardware, such as one of the Allen-Bradley CompactLogix® line of controllers (for example, Allen-Bradley Catalog No. 1769-L18ER-BB1B). Such an exemplary controller 405 can communicate with other equipment in the system using both discrete and analog signals, as well as an Ethernet-based field-bus, such as ODVA® Ethernet/IP™ or EtherCAT® Technology Group, EtherCAT®.

The controller 405 is operatively connected to a human-machine interface (HMI) 415 for communicating the detected position of the gate to the user, communicating warnings to the user, accepting instructions from the user and transmitting them to the controller 405, etc. HMI 415 will be described in greater detail herein below with reference to FIG. 11.

System 400 also includes sensors mounted on the gate and/or operably connected to the gate actuators, for sending data to the controller 405. For example, depending on the particular system, sensors include proximity sensors 420 mounted on the gate and/or the gate attachment points and/or on the sea floor; encoders 425 operably connected to winches or sheaves for generating data relating to the length of opening and closing lines payed out from the winches; and/or load measurement devices 430 operatively connected to the winches for generating data related to line tension and winch torque. System 400 further includes gate actuators such as winches 435, indicator and warning lights 440 mounted to the gate and/or the gate end connections, and gate end latches 445, all of which are controlled by the controller 405. The sensors 420-430 and items 435-445 controlled by the controller 405 will be described in detail herein below.

Those of skill in the art will appreciate that the disclosed marine gate can be of the type that collapses along its length, as shown in FIGS. 2*a*-*c* and 6-8*b*, or of the type that swings open and closed, as shown in FIGS. 3*a*-*b*, since both types of gates feature similar opening/closing operations, have similar line tension characteristics, and can be equipped with similar sensors.

Exemplary embodiments of the disclosure will now be described in detail with reference to FIGS. 6-8*b*. The marine barrier gates of the disclosed systems can be opened and closed using cables or ropes (also referred to as "opening lines" and "closing lines" herein) as described, for example, herein above with reference to FIGS. 2*a*-*c* and in various embodiments of U.S. Pat. No. 9,863,109, entitled "Cable management for marine barriers and gate systems," which is hereby incorporated by reference in its entirety. The cables are attached near the traveling end of the gate, also referred to herein as the free end of the gate, and connect to either fixed or floating platforms referred to herein as attachment points.

Figure 6:
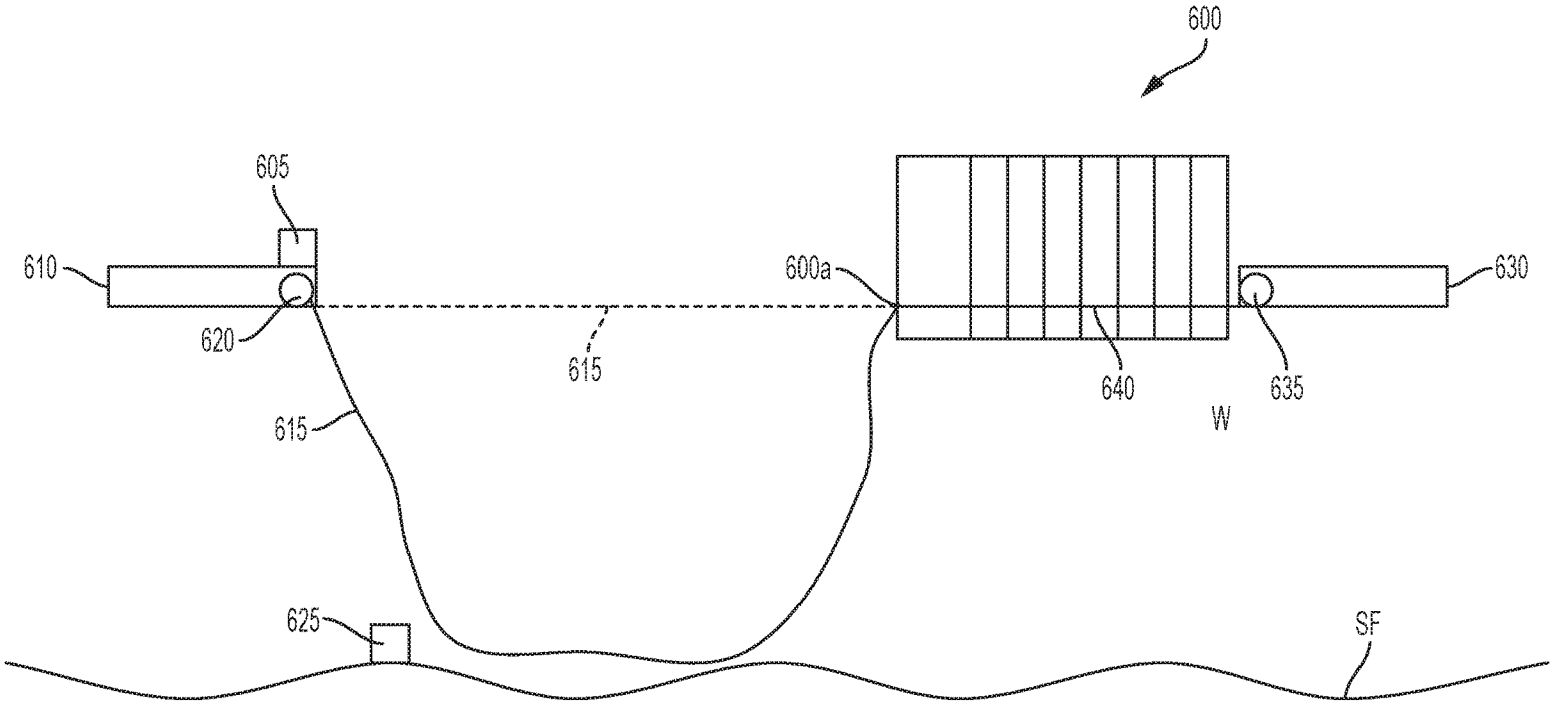
FIG. 6 is a side view of a collapsible gate according to an embodiment of the present disclosure in an open position, showing a proximity detection system to know gate and cable locations.
Figure 7A:
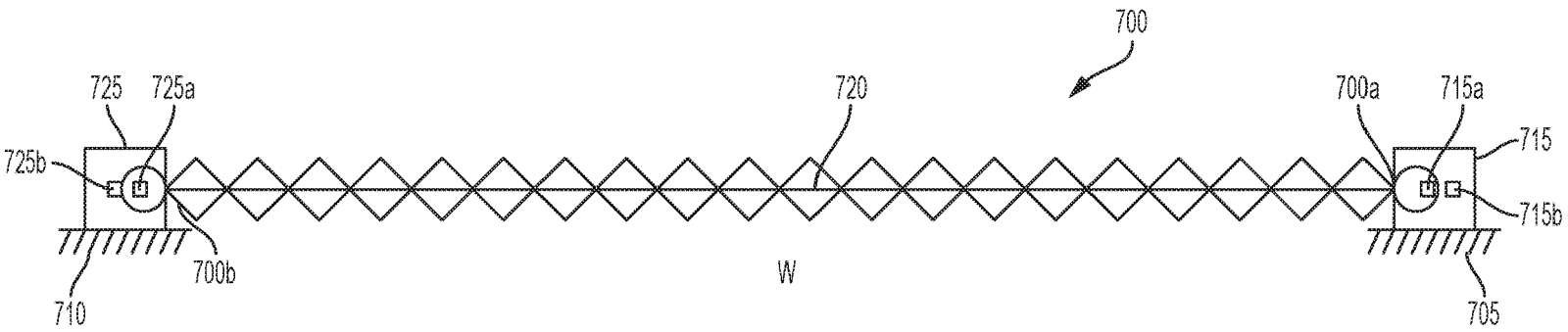
FIGS. 7*a* and 7*b* show top views of a collapsible gate according to another embodiment of the present disclosure in closed and open positions, respectively.
Figure 7B:
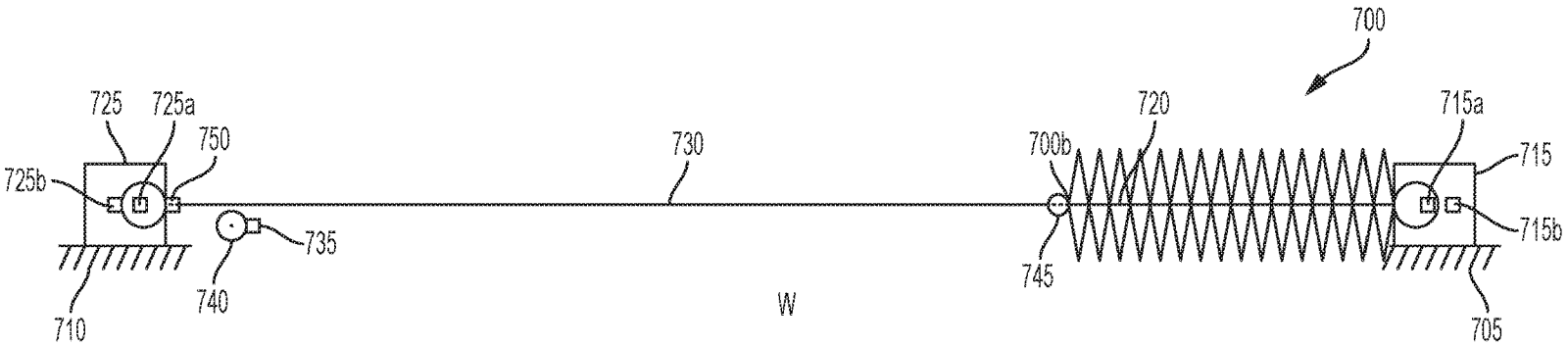

The position of the barrier gate is known by the use of sensors comprising conventional encoders and/or proximity sensors (such as the commercially available Turck B1 encoder, Banner Q45 wireless sensor, Bosch BNO-055 sensor, Baumer BMMx sensor, and AMCI sensors) located on and operably connected to winches and/or sheave assemblies, as shown in FIGS. 6-7*b* and explained in detail herein below. Mounting of encoders or a quadrature of proximity sensors on winch drums or winding structures to approximate line-out or position is conventional in the winching and winding industries. Encoders or proximity sensors are also used in traditional industrial automation equipment, such as conveyor belts, factory tracks, etc., but heretofore have not been used in an automatic marine gate. The encoders measure the amount of line paying off the winch or sheave through rotation counts. The proximity sensors, located on a nose of the movable barrier or on an end connection, provide refined location and help adjust the speed and distance the barrier must travel.

Referring now to FIG. 6, embodiments of the disclosed system include a marine barrier gate 600 having a first proximity sensor 605 mounted at a first end connection 610, for generating a signal when a free end 600*a* of gate 600 is proximal to the first end connection 610. A closing line 615 can be extended from the end connection 610 using a closing winch 620, and a second proximity sensor 625 is mounted below the surface of a body of water W, for generating a signal when closing line 615 is proximal to the second proximity sensor 625. As discussed above with reference to FIG. 4, the system further includes a controller 405 having a processor 410 to receive data from the proximity sensors and process the sensor data to inform a user of a position of the gate.

Figure 11:
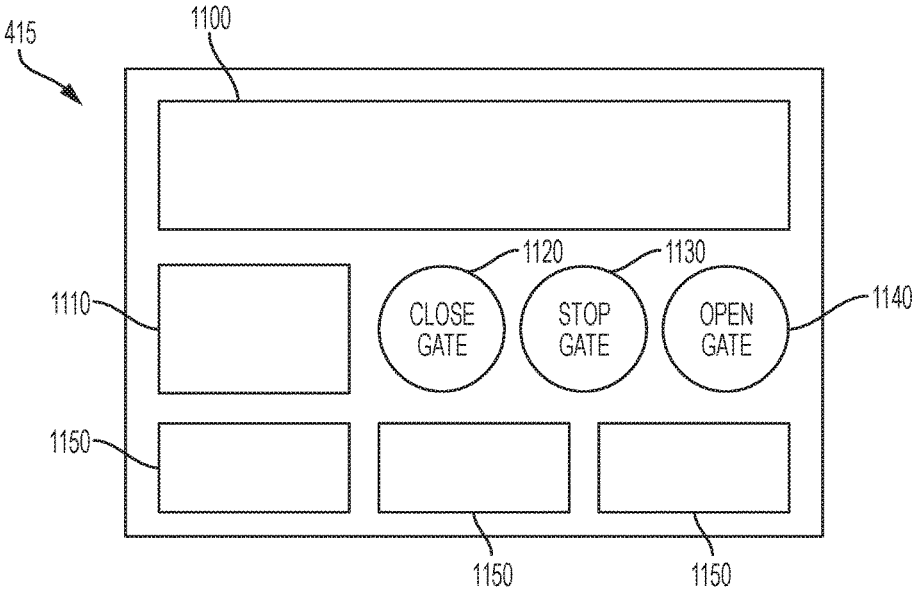
FIG. 11 depicts a human-machine interface (HMI) according to the present disclosure.

When free end 600*a* of the gate 600 is sensed by the first proximity sensor 605, the gate 600 is determined by processor 410 to be in a closed and latched position (not shown). As the gate 600 is opened, as by a winch 635 mounted at a second end connection 630 retracting an opening line 640, first proximity sensor 605 does not sense the end 600*a* of the gate 600, and second proximity sensor 625 does not sense the closing line 615, depicted by dashed lines. The closing line 615 is then extended until it is proximal to the sea floor SF. When the first proximity sensor 605 does not sense the end 600*a* of the gate 600, and the second proximity sensor 625 senses the closing line 615, the processor 410 determines that the gate 600 is in an open position and the cable 615 is extended from the end connection 610. Information from the proximity sensors 605, 625 is received at processor 410 of controller 405, and processed to inform the user of the gate's position and the cable's position via a user interface 1100, as shown in FIG. 11 and discussed in detail herein below. In some embodiments, the second proximity sensor 625 includes an array of proximity sensors on the sea floor SF.

The disclosed system is usable with many marine gates having two winches and cables; for example, the retractable gates described herein above with reference to FIGS. 2*a*-*c* and disclosed at FIGS. 1A-3G of U.S. Pat. No. 9,863,109. Referring now to FIGS. 7*a* and 7*b*, in such exemplary embodiments the disclosed marine gate system comprises a buoyant, variable length barrier gate 700, wherein when the barrier gate 700 is floating in a body of water W, it is movable from a fully expanded position shown in FIG. 7*a* where the barrier gate 700 extends from a substantially stationary first attachment point 705 to a substantially stationary second attachment point 710 remote from the first attachment point 705, to a retracted position shown in FIG. 7*b* where the barrier gate 700 extends from the first attachment point 705 to a location between the first and second attachment points 705, 710. The first attachment point 705 is attached to a first end 700*a* of the barrier gate 700. The marine gate system further comprises an opening winch 715 disposed at the first attachment point 705 and having an opening line 720 attached proximal to a free end 700*b* of the barrier gate 700 opposite the first end 700*a* of the barrier gate, for moving the barrier gate 700 from the fully expanded position (FIG. 7*a*) to the retracted position (FIG. 7*b*) by operation of the opening winch 715. The barrier also has a closing winch 725 disposed at the second attachment point 710 and having a closing line 730 attached proximal to the free end 700*b* of the barrier gate, for moving the barrier gate 700 from the retracted position to the fully expanded position by operation of the closing winch 725.

In certain of these embodiments, at least one of the opening and closing winches 715, 725 has an encoder 715*a*, 725*a* operably attached to a rotating hub that rotates with the motion of the opening or closing line 720, 730, for counting rotations of the hub to generate data that can be used to measure the amount of line paying off the winch. In some embodiments, the rotating hub is a winch drum, and encoders 715*a*, 725*a* are mounted to count a number of rotations of the winch drum of their respective winch. In other embodiments, instead of an encoder for counting rotations of the winch drum, an encoder 735 is operably mounted to a sheave and/or an idler wheel 740 that contacts a line, such as closing line 730, to count rotations of the sheave or idler wheel 740. As discussed above with reference to FIG. 4, the system further includes a controller 405 having a processor 410 to receive data from the encoders and process the encoder data to inform a user of a position of the gate. In an exemplary embodiment, when the gate 700 is moving from the fully expanded position of FIG. 7*a* to the retracted position of FIG. 7*b* by operation of the opening winch 715, the encoder of the closing winch 725 measures the amount of the closing line 730 payed off the closing winch 725, and the processor 410 is for calculating the position of the gate 700 based on the encoder data.

The system operates as follows, using these measurement devices. Note that the operating steps presented here are similar to the ones discussed in U.S. Pat. No. 9,863,109. First, the operator instructs the gate 700 to open, via a button control on a control panel, or a human machine interface (HMI) device such as HMI 415, or via software. The opening winch 715 begins to pull the gate 700 open, bringing line 730 off the closing winch 725. The amount of line 730 payed off the drum of the closing winch 725 determines the position of the gate 700, and is monitored in real time, presented to the operator, and seen in the HMI interface 415 or other indicating device. In a further embodiment, the opening winch 715 determines the closed position and the closing winch 725 determines the opened position. This is possible because the relevant system components (e.g., encoders 715*a*, 725*a* and lines 720, 730) are continuously connected.

Once the line measurement device (e.g., encoder 715*a* or 725*a*) measures a predetermined amount of line, the opening winch 715 stops. In certain embodiments, the closing winch 725 pays out closing line 730, dropping the cable 730 to the seafloor, as shown in FIG. 6 and discussed herein above, to allow vessels safe passage. Once the proper amount of closing winch line 730 has been payed out, the operator is informed that the gate 700 is open. In other words, the encoder 725*a* of the closing winch 725 counts the rotations of the drum of the closing winch 725 as the closing line 730 is payed off the closing winch 725, and the processor 410 is for calculating the position of the closing line 730 based on the encoder data. An additional proximity sensor can monitor the position of the closing line to sense when the cable is on the seafloor, similar to the embodiment of FIG. 6.

In other embodiments, the closing winch line is released from the gate via a latch 745, and the closing winch 725 then brings in the remaining line, and the operator is informed that the gate is open. Thus, the encoder 725*a* of the closing winch 725 counts the rotations of the drum of the closing winch 725 as the closing line 730 is wound onto the closing winch 725, and the processor 410 calculates the position of the closing line 730 based on the encoder data.

The steps to close the gate 700 are reversed. In embodiments where the closing line 730 is dropped to the seafloor, the closing winch 725 begins to pay in line 730 (e.g., once the system has been initialized or after a pre-determined amount of time), at the same time drawing line 720 off the opening winch 715. The encoder 725*a* of the closing winch 725 measures the amount of the closing line 730 payed in, and the processor 410 is for calculating the position of the closing line 730 based on the encoder data. If the closing winch 725 does not have accurate intake data, a proximity sensor 750 can control the winch 725 as the gate approaches the second attachment point 710, to monitor the exact location of the end column of the gate (i.e., free end 700*b*) to provide exact location reference. This prevents count discrepancies from winch or sheave mounted encoders or proximity sensors from detrimentally affecting the closing or opening of the system. Once the gate 700 is closed, the system checks the line measurement device (i.e., encoder 725*a*) coupled with the proximity sensor 750, to let the operator know the status of the gate (e.g., securely fastened).

Those of skill in the art will appreciate that in other embodiments, the opening winch encoder 715*a* sends data to the processor 410 to monitor the position of the gate 700. In still further embodiments, data from encoders 715*a*, 725*a* of both winches 715, 725 is used by the processor 410 to calculate the position of the gate 700.

Figure 8A:
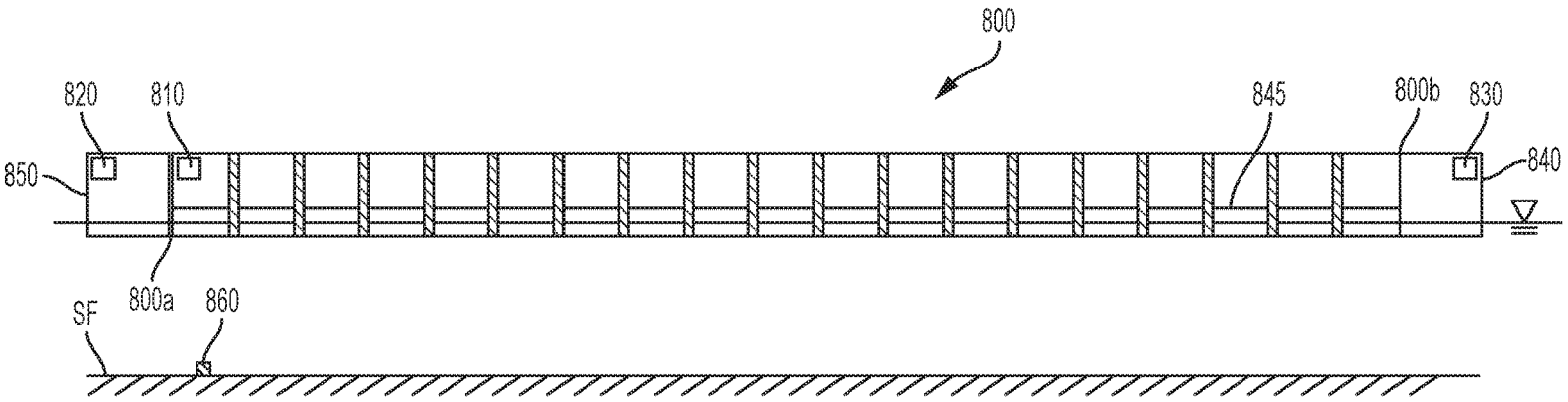
FIGS. 8*a* and 8*b* show side views of a collapsible gate according to a further embodiment of to the present disclosure in closed and open positions, respectively.
Figure 8B:
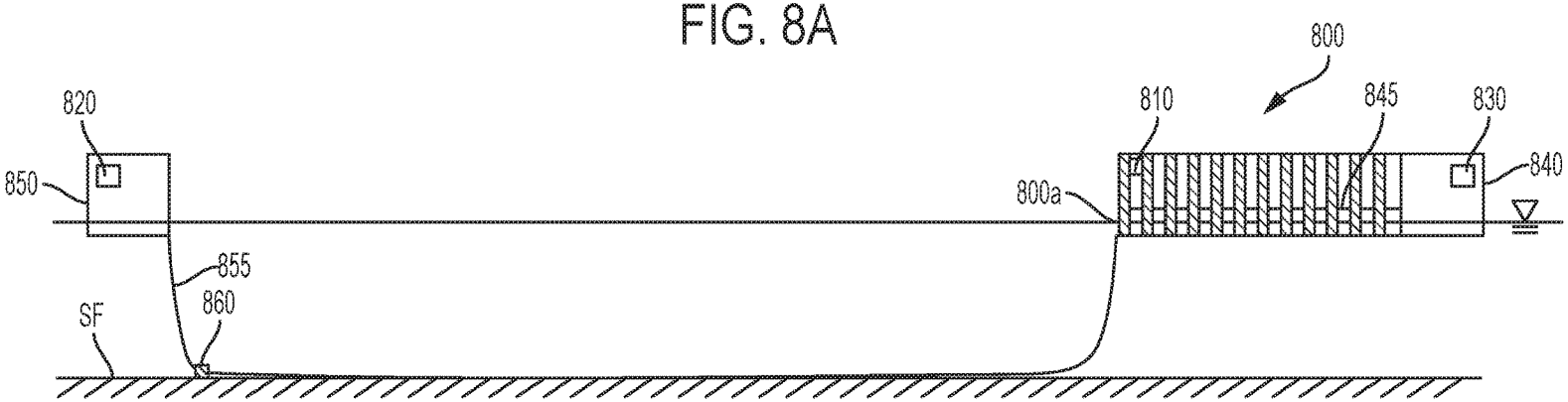

FIGS. 8*a* and 8*b* show side views of another collapsible gate 800 according to the present disclosure closed and open, respectively, having global positioning system (GPS) sensors 810, 820, 830 to determine and monitor gate position. As discussed above with reference to FIG. 4, the system further includes a controller 405 having a processor 410 to receive data from the GPS sensors 810, 820, 830 and process the sensor data to inform a user of a position of the gate 800.

In an exemplary embodiment, data from GPS sensor 810 at the free end 800*a* of the gate 800 is used by the processor 410 to determine an open or closed position of the gate 800. As an opening winch 840 begins to pull the gate 800 open via an opening line 845, the processor 410 uses data from the GPS sensor 810 to determine the position of the gate 800, and a closing winch 850 pays out a closing line 855. The processor 410 can monitor the gate position in close to real time (e.g., within 1.5 seconds of command and system response) and present it to the operator, as by an HMI interface 415 or other indicating device.

As shown in FIG. 8*b*, when the GPS sensor 810 indicates the gate position has reached a predetermined set up, the opening winch 840 stops. In certain embodiments, the closing winch 850 pays out closing line 855, dropping it to the seafloor SF, where it is sensed by a proximity sensor 860. Once the proximity sensor 860 senses the closing cable 855, the operator is informed that the gate 800 is open. The steps to close the gate 800 are reversed, with the GPS sensor data used by the processor 410 to determine and inform the user when the gate 800 is closed. GPS sensors 820, 830 at one or both end connections of the gate are used to determine approximate positions of the gate ends 800*a*, 800*b*. In systems that use non-stationary end connections, the final open-gate closing line 855 payout is determined based on the difference between the end connection coordinates from sensors 820 and 830, and the coordinates of the moving end 800*a* of the gate (sensor 810) from a calibrated position.

Human-Machine Interface (HMI)

During operation, the position, line tension and other relevant information can be provided to the operator via control panel indication lights, analogue or digital gauges, and/or an alphanumeric indicating device, and/or an HMI 415 as seen in FIG. 11. This HMI lets operators know the exact location of the barrier and overall system status.

FIG. 11 illustrates an exemplary human-machine interface (HMI 415) that provides operators with the status of the gate position at any point along its operating path. The dedicated HMI 415 allows for operator interaction with the machine and device feedback from the machine. The machine status is indicated through an animated graphic or numerical output 1100 located prominently on the interface 415. Current gate operation or location 1110 is indicated to the left of the primary operator inputs 1120, 1130, 1140; e.g., buttons for "close gate," "stop gate," and "open gate." An optional 4th button for "partial open gate" (not shown) may be inserted in the row. Interface screens 1150 for setup, cameras, calibration, and alternate operating modes can be accessed on the lower portion of the interface 415.

The HMI 415 or software presents information relating to the status of any latches, the position of the gate along its open/closed length, system tension, and warnings. It can also provide a visual reference; for example, incorporating camera views of critical components to allow monitoring of critical infrastructure.

Using Winching Line Tension to Control and Monitor Gate Operation

In certain embodiments, winching line tension is used to maneuver and control the gate while it transits to the desired open, partially open, or closed position. When the gate is opening, the opening winch provides motive torque to pay in the opening line, while the closing winch provides back tension while paying out the closing line. When the gate is closing, the closing winch provides motive torque to pay in the closing line, and the opening winch provides back tension while paying out the opening line. Referring now to exemplary gate 200 shown in FIGS. 2*a*-*b*, when gate 200 is opening, opening winch 210 provides motive torque to pay in an opening line 215, while a closing winch 220 provides back tension while paying out a closing line 225. When the gate is closing, the closing winch 220 provides motive torque to pay in the closing line 225, and the opening winch 210 provides back tension while paying out the opening line 215.

Embodiments utilize the winches in opposite configurations of torque and speed regulation. Other embodiments include both the winches providing tension regulation. Again using gate 200 of FIG. 2 as an example, in one embodiment, when the gate 200 is opening, the opening winch 210 operates as the tension (winch torque) regulator, while the closing winch 220 operates as a speed regulator. In another embodiment, while the gate 200 is opening, the opening winch 210 operates as a speed regulator, while the closing winch 220 operates as the tension (winch torque) regulator.

Referring now to FIGS. 7*a* and 7*b*, in certain exemplary embodiments similar to that of FIG. 2, when the gate 700 is moving from the fully expanded position shown in FIG. 7*a* to the retracted position shown in FIG. 7*b*, the opening winch 715 provides motive torque to pay in the opening line 720, and the closing winch 725 provides back tension while paying out the closing line 730. When the gate 700 is moving from the retracted position to the fully expanded position, the closing winch 725 provides motive torque to pay in the closing line 730, and the opening winch 715 provides back tension while paying out the opening line 720.

In certain of these embodiments, the opening and closing winches 715, 725 each have a load measurement device 715*b*, 725*b* to measure tension in the opening and closing lines 720, 730, respectively. The system processor 410 receives data from the load measurement devices 715*b*, 725*b*, and process the data to control the speed of the gate 700 and the tension in the opening and closing lines 720, 730. In an exemplary embodiment, when the gate 700 is moving from the fully expanded position of FIG. 7*a* to the retracted position of FIG. 7*b* by operation of the opening winch 715, data from the load measurement device 725*b* of the closing winch 725 is used by the processor 410 to control the line tension within a predetermined tension range, and data from the load measurement device 715*b* of the opening winch 715 is used by the processor 410 to control the gate speed within a predetermined speed range. In an alternative embodiment, when the gate 700 is moving from the fully expanded position of FIG. 7*a* to the retracted position of FIG. 7*b* by operation of the opening winch 715, data from the load measurement device 725*b* of the closing winch 725 is used by the processor 410 to control the gate speed within the predetermined speed range, and data from the load measurement device 715*b* of the opening winch 715 is used by the processor 410 to control the line tension within the predetermined tension range.

Operating tension is adjustable through an automatic algorithm programmed into and executed by processor 410, written in a well-known industrial programming language such as an IEC 611 31-3 language, or through operator input of desired operating torque. Embodiments using an automatic algorithm programmed into and executed by processor 410 monitor gate operating speed; if the speed falls below a calibrated threshold, the operating torque incrementally increases until a desired speed is reached unless maximum torque has already been obtained. Embodiments using the operator input method track a torque setpoint inputted by the operator via an analogue potentiometer (such as a P3 America JL30) or via numerical entry on a graphical user interface, such as HMI 415.

Operating torque can be monitored in a variety of ways. If the winches 715, 725 have electric motors, a well-known field-oriented control motor model, or a combination of this motor model and a position feedback device (i.e., a conventional motor-mounted rotary encoder used as a load measurement device 715*b*, 725*b*) is used by processor 410 to determine the operating torque. If the winches 715, 725 have hydraulic motors, a pressure transducer is included in a torque monitoring circuit as a load measurement device 715*b*, 725*b* to determine hydraulic pressure consumed by the motor, thus enabling processor 410 to calculate the torque. Embodiments of this operating mode are enhanced using a load cell as a load measurement device 715*b*, 725*b* to determine actual line tension, such as a Load Pin available from Strainsert Company of West Conshohocken, Pa.

The motor torque is typically used to measure the line tension. However, to measure tensions in the cables, required for safety or information purposes, the system can be outfitted with strain gauges or load pins or measurement instrumentation built into the winch itself as load measurement devices 715*b*, 725*b*.

Torque is controlled in a variety of ways. If the winches 715, 725 have electric motors, a motor variable-frequency drive (such as an Allen Bradley Powerflex 755 AC Drive, available from Rockwell Automation of Milwaukee, Wis.) can use a well-known field-oriented motor model to determine the proportion of output current and timing of the current to create torque producing current. If the winches 715, 725 have hydraulic motors, the motor hydraulic circuit pressure control valve (such as a Model HVC pressure control valve available from Sun Hydraulics of Sarasota, Fla.), in combination with the output pressure feedback device, meters pressure to the motor circuit to produce torque.

The above-referenced field-oriented motor model is a variable-frequency drive calibrated model of the winch motor. It allows the variable-frequency drive to know the proportion of current that goes into flux generating current and the proportion that goes into torque-generating current, and thus regulate the current and the timing of current to allow for continuously variable torque control of the motor. This system of control has been developed for the industrial market since the early 1980's in such applications as paper winding. Its application to winching systems for equipment towing is unique. By utilizing this control method, system back tension (i.e., of the opening and closing lines) can be controlled without the use of a tail brake, disk brake, drum brake, or other physical braking method. All tension control is through electronic or hydraulic means. This enhances efficiency and decreases maintenance by reducing the amount of moving and wear parts.

Two of the above exemplary embodiments of a tension control algorithm executed by processor 410 will now be described with reference to the flow chart of FIG. 5. In one embodiment where the operating tension is adjustable through an automatic algorithm, at step 500 the tension setpoint is determined via software, and is converted to a desired operating torque, such as in the form of a torque percentage, at step 505. A motor speed reference (step 510) is fed into the algorithm at step 525, and the operating current (step 515) is used in a well-known field-oriented control motor model (FOC) at step 520, the result of which is also fed into the algorithm at step 525, where the operating torque is calculated and monitored. At step 530, the calculated operating torque from step 525 is compared to the setpoint torque from step 505. If the operating torque is greater than the setpoint, the motor speed is increased at step 535. If the operating torque is not greater than the setpoint, the motor speed is decreased at step 540. At step 545, the motor speed is compared to predetermined speed limits, and if it is within the limits, the torque regulation continues at step 550. If it is not within the limits, the operator is alerted at step 555.

Figure 5:
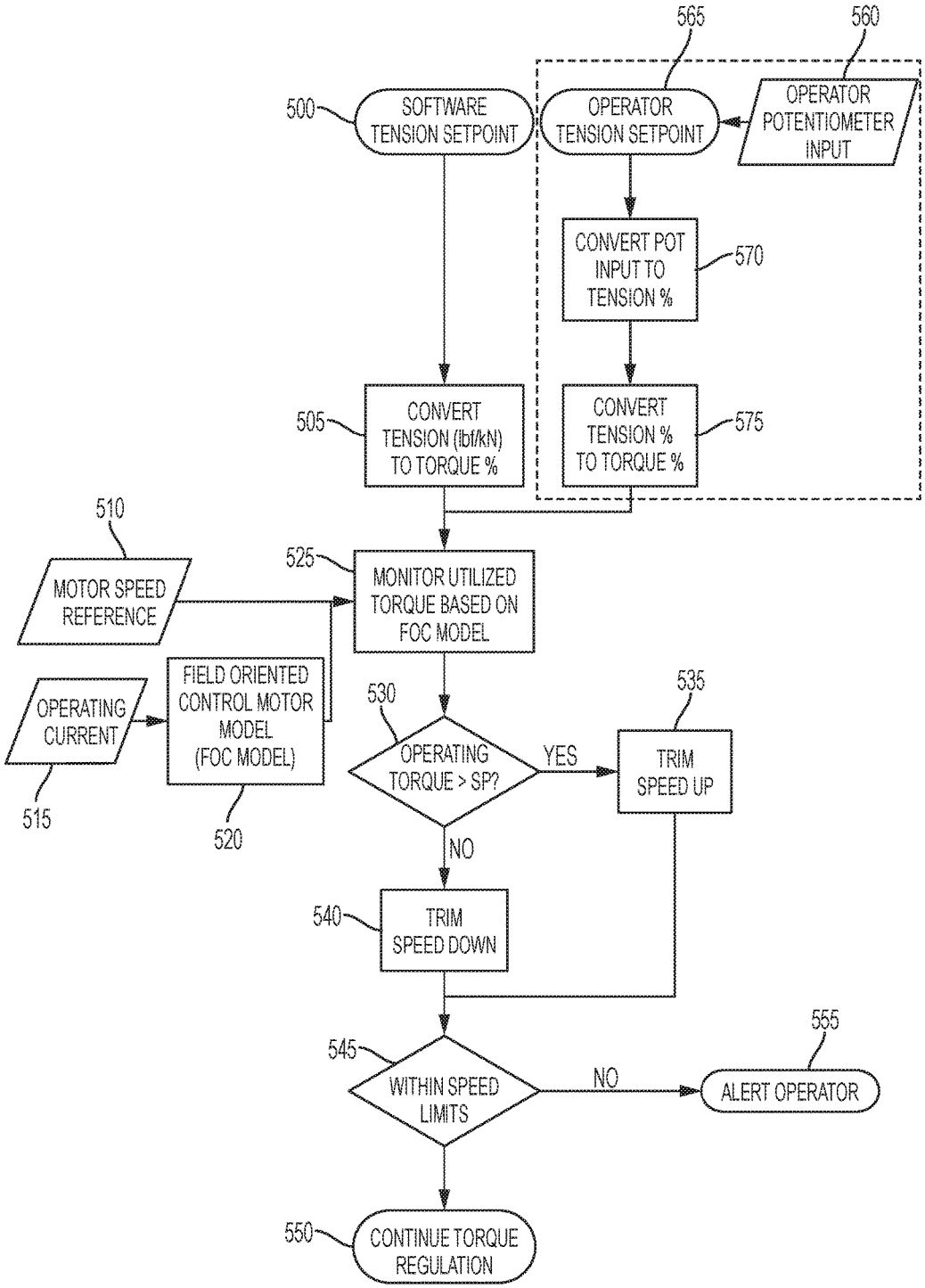
FIG. 5 is a flow chart showing a gate position control algorithm according to an embodiment of the present disclosure and how it is tied to a torque control algorithm.

In an alternative embodiment also shown in FIG. 5, operating tension is manually adjusted through operator input of desired operating torque. The operator inputs through a potentiometer at step 560 to choose a tension setpoint (step 565). The potentiometer input is converted to tension at step 570, and the tension is converted to a torque value at step 575. The algorithm then continues as described herein above from steps 510 to 555.

The disclosed gate position control algorithm is tied to the aforementioned torque control algorithm, loaded into a process logic controller (PLC) included in the controller 405 or processor 410; such as an Allen Bradley Compact Logics 537L2 PLC, available from Rockwell Automation of Milwaukee, Wis. As discussed herein above in detail, gate position is determined through sensor input to the PLC; end and transient positions are determined through rotary encoder(s) (such as a Baumer BMMV encoder) mounted to the winch drum, winch motor, or combination of the two. Certain embodiments include supplementation of end position determination by proximity sensors.

In some embodiments, linear position measurement is accomplished using well-known proximity sensors such as inductive, ultrasonic, or radio proximity devices, and/or fixed contact limit switches. These proximity type devices will be mounted to the end structure—whether a buoy or pier-based skid, to measure contact or presence of the gate structure or device mounted to the towing cable.

A Calibration System for Determining Limit Stops for Gate Operation

Calibration of the gate open and closed positions can be performed automatically or manually. In manual calibration mode, the gate, after deployment, is placed in the open gate or closed gate position. Limit switches are set (digitally or physically—by the operator). The gate is cycled to the opposite location, closed gate or open gate respectively, and limit switches are set (digitally or physically—by the operator). In automatic calibration mode, the gate control system is placed in calibration mode, the end user initiates the calibration sequence, and the gate performs the calibration sequence itself with no further operator input. The term "set" or "setting a limit switch" refers to moving positional information from an encoder (usually a DINT dual-integer) to a separate variable. Limit switch settings are stored in a conventional memory that is part of the system controller and/or processor. The limit switch setting process is detailed in the flow charts of FIGS. 14*a-c*.

Figure 14A:
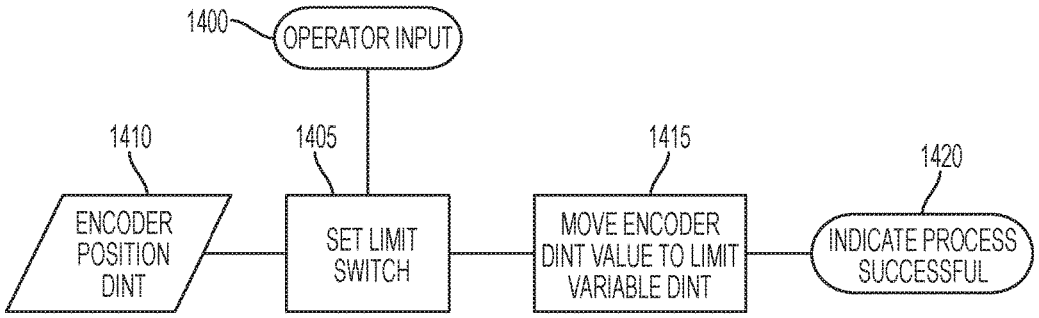
FIGS. 14*a-c* are flow charts showing processes for setting digital limit switch(es) using operator and software inputs.
Figure 14B:
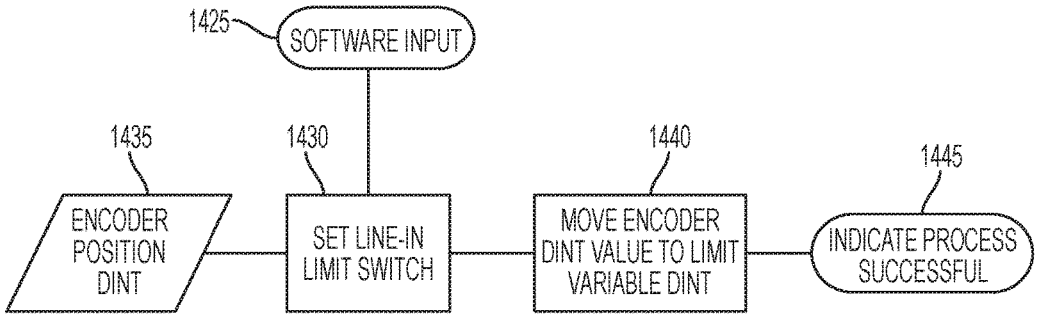

FIG. 14*a* shows the steps required, and inputs/outputs for, an operator setting a digital limit switch. First, at step 1400, the operator initiates the limit switch setting procedure. At step 1405, the desired limit switch is set according to the encoder position DINT 1410 from an encoder, and at step 1415 the encoder DINT is moved (i.e., copied) to a separate variable "Limit Variable DINT." The process is indicated as being successful at step 1420. FIG. 14*b* shows the steps required, and inputs/outputs for, software performing the task for a signal position. First, at step 1425, the software initiates the limit switch setting procedure. At step 1430, the desired limit switch is set according to the encoder position DINT 1435 from an encoder, and at step 1440 the encoder DINT is moved (i.e., copied) to a separate variable "Limit Variable DINT." The process is indicated as being successful at step 1445.

Figure 14C:
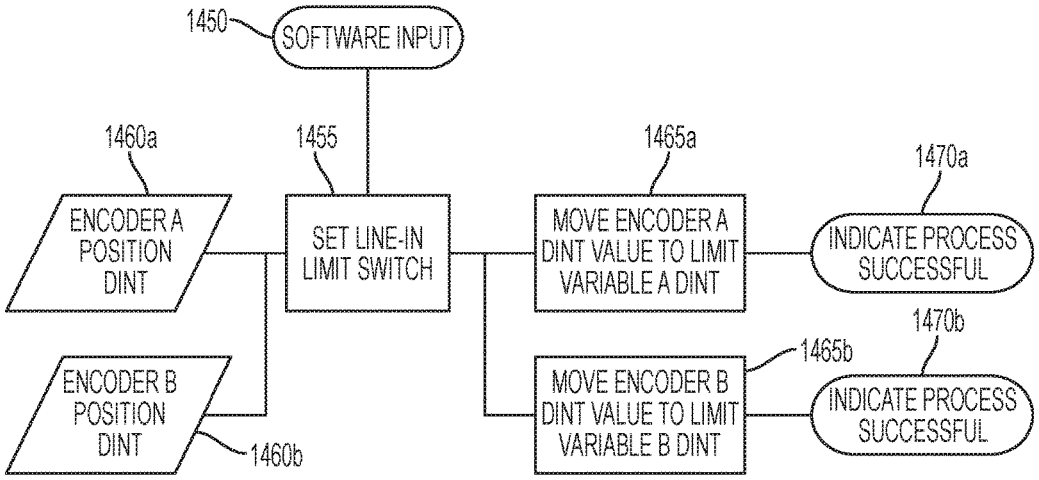

FIG. 14*c* presents the steps required, as well as the inputs/outputs for, software setting multiple digital limits; e.g., setting limit switches during a partial open sequence where both opening and closing line positions are recorded and stored. First, at step 1450, the software initiates the limit switch setting procedure. At step 1455, the desired limit switches are set according to the encoder positions DINT 1460*a*, 1460*b* from each of the two encoders "A" and "B." At steps 1465*a* and 1465*a* the encoder DINTS are moved (i.e., copied) to a separate variable "Limit Variable A DINT" and "Limit Variable B DINT," respectively. The process is indicated as being successful at steps 1470*a* and 1470*b*.

Embodiments of the automatic calibration mode include starting from the open gate position with the opening and closing winch tow lines in their appropriate positions. The operator begins the calibration sequence by issuing a command. The gate limits are set for the open gate position. The gate then closes until the closed gate position limits are engaged and the closed gate position limit switches are set. Alternative embodiments of this mode include using the closing winch measured torque (and therefore line-tension) to determine when the gate is closed, and setting the closed gate limit switch accordingly.

Embodiments of the automatic calibration mode include starting from an unknown gate position with the opening and closing tow lines in an unknown position. The operator begins the automatic calibration sequence by issuing a command. The gate then closes until the gate position limits are engaged and the gate closed position limit switches are set. The gate then opens until the open gate limits are engaged and the open gate position limits switches are set. A sensor mounted on the seafloor as shown in FIG. 6 is used to determine if the gate closing line is sufficiently lowered for the open gate sequence. The gate then sets the close gate tow line open limit switch. Alternative embodiments of this mode include using the opening and closing winch measured torque (and therefore line tension) to determine when the gate is in the opened and closed position. A mechanical sensor on the winch indicates the proper cable has been payed out, or a sensor on the seafloor determines the location of the cable on the seafloor.

The calibration procedure can be initiated once (during initial gate start-up) or prior to every time the gate is opened or closed.

Calibration of the limit switches is important to system operation as it provides the control algorithm with desired stopping locations during the gate towing routines. This is critical in operating the gate automatically—or without operator intervention or oversight.

Figure 12:
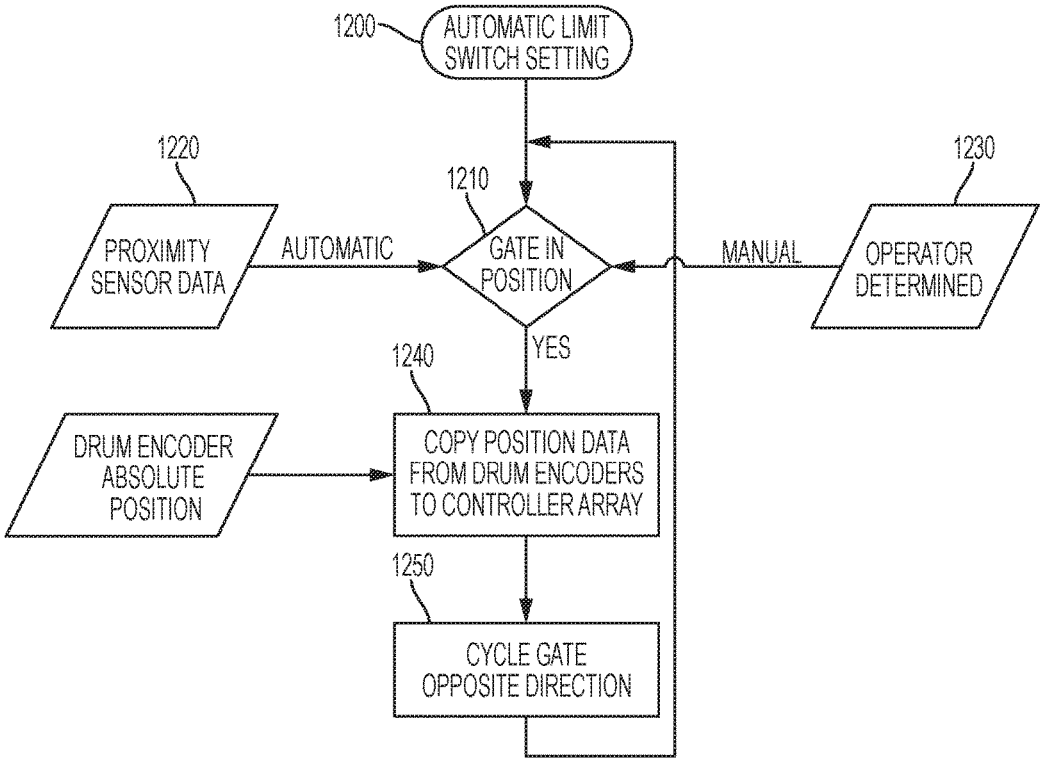
FIG. 12 is a flow chart showing an automatic limit switch set-up process according to the present disclosure.

FIG. 12 shows the automatic limit switch set-up process. Automatic limit switch calibration 1200, after being initiated by software or the operator, determines if the gate is in position at step 1210 by either reading rotary encoder position data (step 1220) or by the operator predetermining the position accuracy and manually inputting its state into an interface (step 1230). The locational information is copied from the sensor data 1220 or operator data 1230 to a variable in the controller indicating it as a limit position at step 1240. The gate is then directed to cycle into its opposite location (from open to close or close to open) at step 1250. Once the gate is determined to be in the correct location, either through sensor feedback (step 1220) or operator interaction (step 1230), the process is repeated. If a partial open position is used in the installed gate, the process is repeated a third time.

Figure 13A:
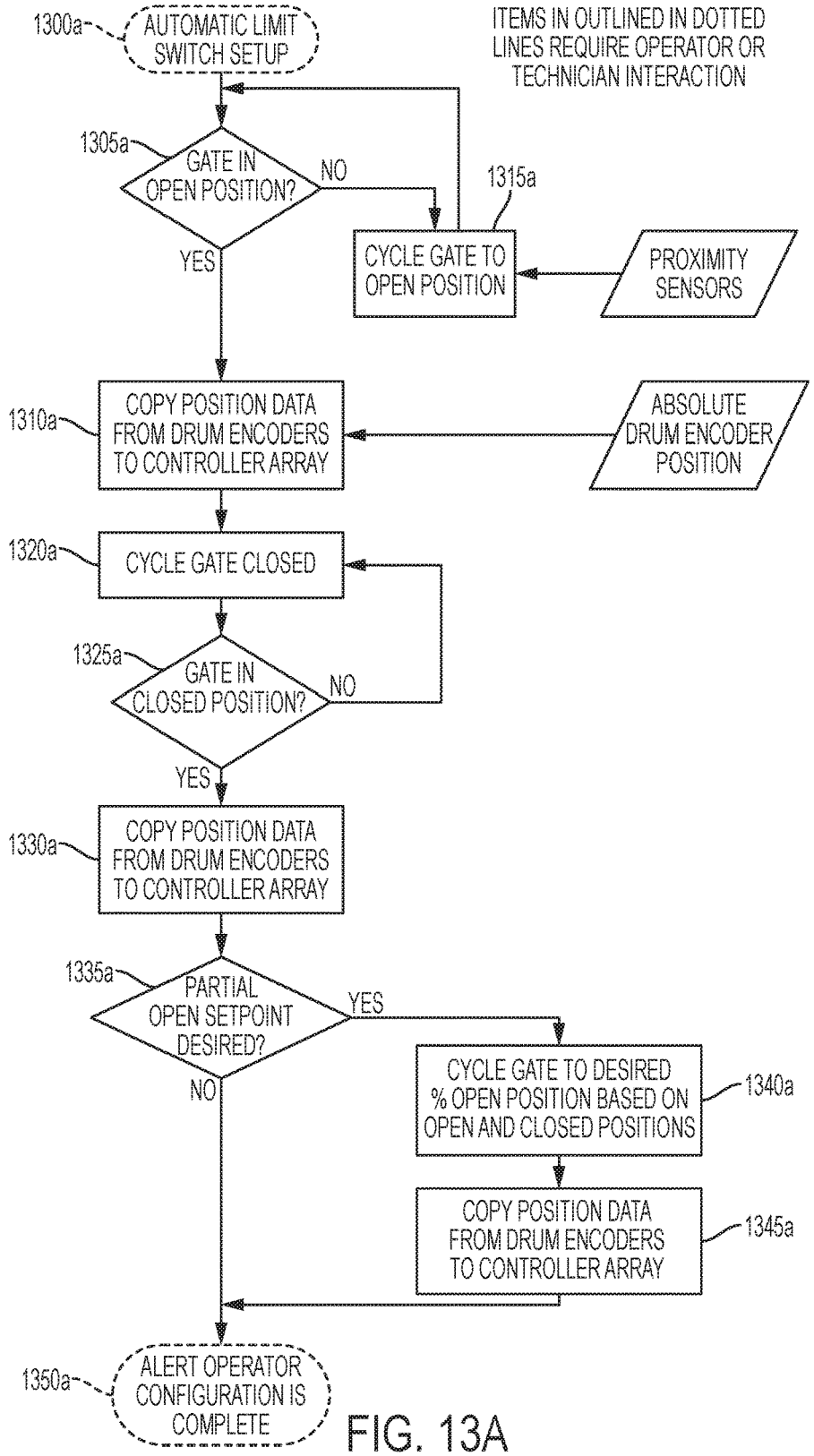
FIGS. 13*a-b* are flow charts respectively showing a manual and an automatic limit switch calibration procedure according to the present disclosure.
Figure 13B:
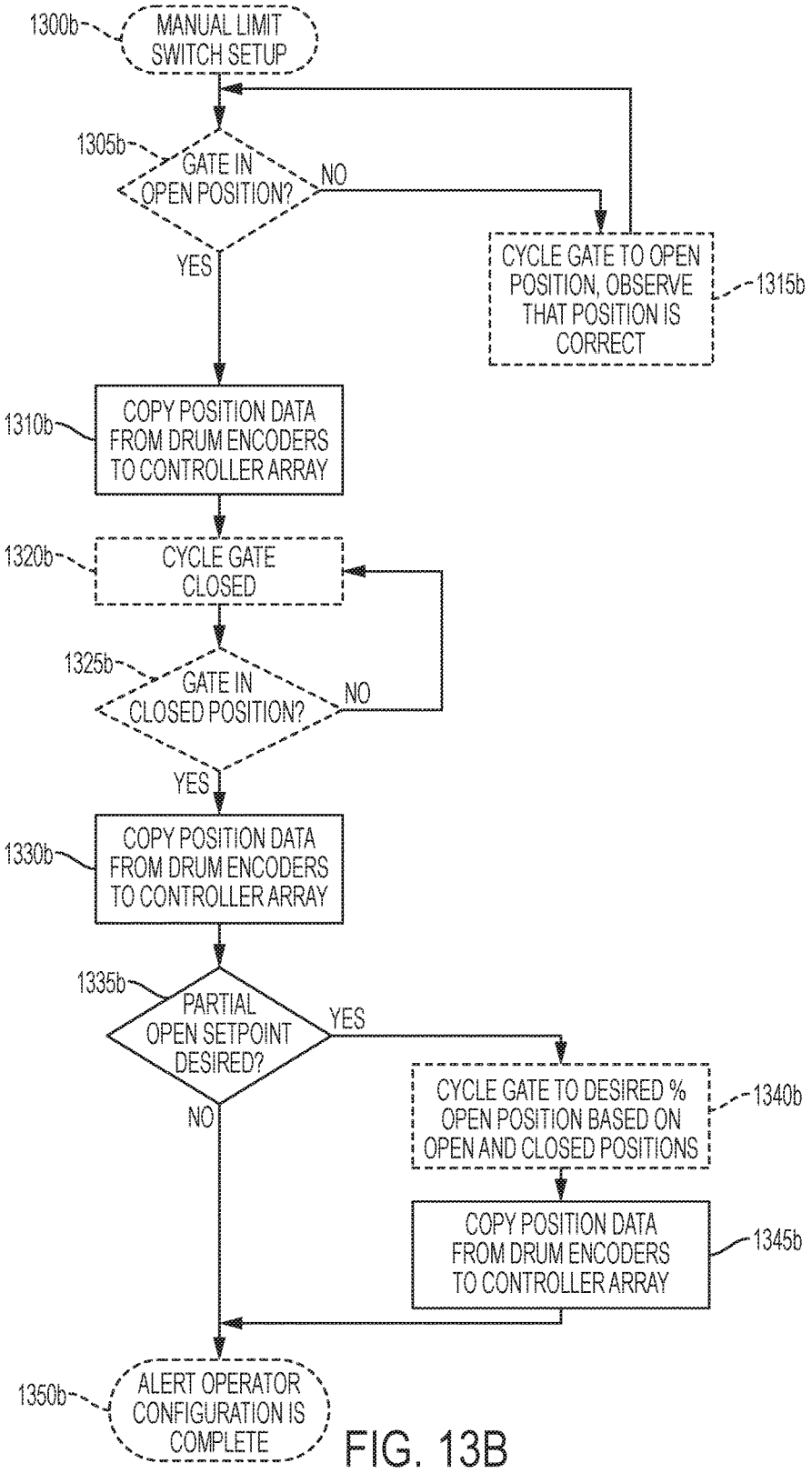

FIGS. 13*a-b* show the limit switch set-up process when the calibration sets are set automatically and manually, respectively. In automatic mode (FIG. 13*a*) the process is started via operator instruction or through periodic software checks at step 1300*a*. The gate position is checked via sensors—proximity or rotary—at step 1305*a*. If the gate is open, the positional data from the proximity sensors and/or rotary encoders is copied into the digital limit switch array at step 1310*a*. If the gate is not open, the gate is cycled towards the open position until the proximity sensors and/or rotary encoders determine the gate is open (step 1315*a*). This can be supplemented with torque feedback from the variable frequency drive. Once this operation is performed the gate is cycled into the closed position (step 1320*a*) as determined by the proximity sensors and/or rotary encoders. Once in position (step 1325*a*), this positional information is copied into the digital limit switch array at step 1330*a*. If the partial open position is desired (step 1335*a*) the process is repeated for the partial open position at steps 1340*a* and 1345*a*. Once completed, an alert signal is sent to the operator HMI or button interface that the operation is complete (step 1350*a*).

In manual mode (FIG. 13*b*), the process is started via operator instruction at step 1300*b*. The gate position is checked via sensors—proximity or rotary, at step 1305*b* and may be supplemented by operator observation. If the gate is open the positional data from the proximity sensors and/or rotary encoders is copied into the digital limit switch array at step 1310*b*. If the gate is not open, the gate is cycled towards the open position until the proximity sensors and/or rotary encoders determine the gate is open at step 1315*b*. This may be supplemented by operator observation and interaction. Once this operation is performed, the gate is cycled into the closed position as determined by the proximity sensors and/or rotary encoders and/or operator observation at step 1320*b*. Once in position (step 1325*b*), this positional information is copied into the digital limit switch array at step 1330*b*. If the partial open position is desired (step 1335*b*), the process is repeated for the partial open position at steps 1340*b* and 1345*b*. Once completed, an alert signal is sent to the operator HMI or button interface that the operation is complete (step 1350*b*). An operator checks that the cycle is complete by checking that the gate cycles accordingly between limits.

An example of the limit-setting procedure will now be described with reference to FIGS. 7*a* and 7*b*, wherein the processor 410 is for calibrating the system by moving the gate 700 to the open position of FIG. 7*b* based on the encoder data from encoders 715*a*, 725*a* or based on input from a user. The data from the two encoders 715*a*, 725*a* is stored as open position data in the controller's memory. Processor 410 then moves the gate 700 to the closed position of FIG. 7*a* based on updated encoder data or based on input from the user. The updated encoder data corresponding to when the gate is in the closed position is then stored as closed position data in the memory 450.

In further embodiments, if the system has a proximity sensor 750 to indicate when the gate 700 is closed, the closed-gate signal from sensor 750 is also stored as part of the closed position data. Likewise, in embodiments having a second sensor to generate a signal indicating the gate is open, such as the proximity sensor 625 on the sea floor in FIG. 6 for generating a signal when the closing line is proximal to the closing line proximity sensor, or an additional position sensor on the gate itself (such as the GPS sensor 810 in FIGS. 8*a-b*), the opened-gate signal is stored as part of the open position data in the memory 450.

In other embodiments, the processor is for setting a desired partial open position of the gate 700 by moving the gate 700 to the partial open position based on encoder data from encoders 715*a*, 715*b* or based on input from the user, and storing the encoder data corresponding to when the gate is in the partial open position as partial open position data in the memory 450.

Indication Lights on Barrier, Gate, or End Connection

A barrier gate according to this embodiment is outfitted with marine lights, including standard amber/yellow lights used at night to warn others of an obstruction, and navigation lights (red/green) to inform others when and where to pass through the gate. The standard solar powered amber/yellow lights are commercial off the shelf products; for example, the SL60 by Sealite. The lights are used in conjunction with the proximity sensors and other sensors discussed in the previous sections such that when the sensors indicate, for example, that a latch is secure or the proper amount of cable has been payed out, the proper light(s) turn on or off. The lights of this embodiment can be fitted to any disclosed system.

Figure 10A:
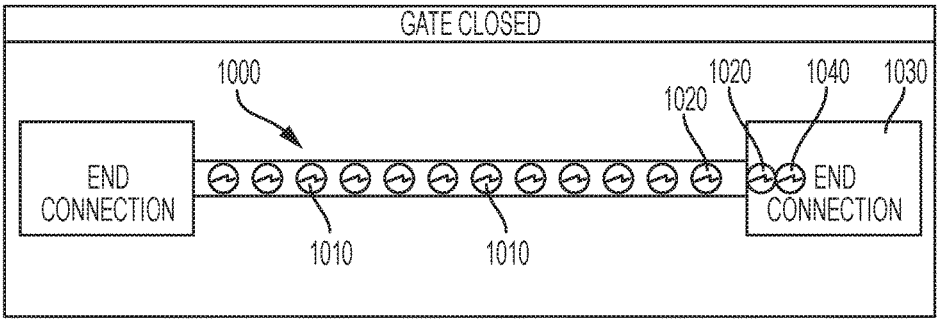
FIGS. 10*a-c* depict top views of gate warning and status lighting according to an embodiment of the present disclosure.
Figure 10B:
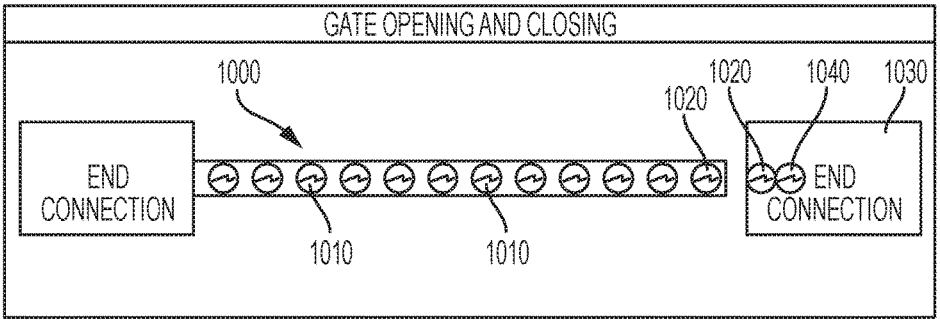
Figure 10C:
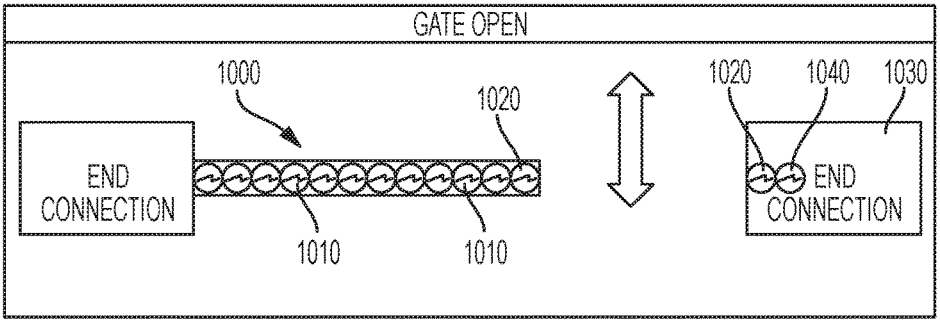

The basic lighting scheme employed to indicate to vessel operators safe passage is presented in FIGS. 10*a-c*. According to this embodiment, the barrier 1000 is outfitted with standard amber lights 1010 every few meters. These solar/battery power lights may turn on at night to warn vessels of the presence of the barrier (see FIG. 10*a*).

To indicate to vessel operators if it is safe to pass through the gate 1000, navigation lights 1020 are mounted on the leading edge of the barrier 1000 and one end connection 1030. Lights 1020 are typically red or green, but may be other colors where deemed appropriate. When the gate 1000 is fully open (see FIG. 10*c*), lights 1020 will either blink or be steady, indicating to vessels that it is safe to pass.

While the gate 1000 is operating (see FIG. 10*b*), or if the system diagnoses an error, the red and/or green navigation lights 1020 will not operate. These will be off, with a yellow blinking or steady light 1040 in its place. Light 1040 warns operators and/or vessels that it is not safe to pass.

Note that the solar powered amber lights 1010 may be turned off when the gate 1000 is fully opened (see FIG. 10*c*); however, this is not required.

Indication of these lights is present on the water (at the location of the gate) as well as remotely in the control room; for example, displayed on the HMI 415.

Warning and Status Features

The use of cables, sensors and lights as described herein above allow the disclosed systems to monitor their status and indicate to the operators or other vessels the status of the gate. This provides the systems with unique features to perform the following warning and/or status functions depending on whether the gate is closed, open, or in the process of opening or closing.

When the gate is closed: In a disclosed system such as that of FIGS. 7*a-b* comprising winches 715, 725 or sheaves 740 having encoders 715*a*, 725*a*, 735, if any cable pays off a winch due to impact events, tampering, or environmental loads, the operators are informed by processor 410 and HMI 415. Also in a disclosed system such as that of FIGS. 7*a-b* comprising winches 715, 725 having load measurement devices 715*b*, 725*b*, if line tension reaches a predetermined set point due to environmental loads or an impact event, processor 410 is for informing the operator and/or stopping the system stop or relieving the tension. If the end column of the gate (i.e., free end 700*b*) is no longer being measured by a corresponding proximity sensor 750 due to tampering or illegal entry, the operator is informed by processor 410 via HMI 415. If the encoder data from encoders 715*a*, 725*a*, 735 indicates different amounts of line payed off the respective drums of winches 715, 725 compared to a predetermined set point length, the operator is informed by processor 410 via HMI 415.

When the gate is open: Referring again to FIGS. 7*a-b* as an exemplary disclosed system, if the tension in the closing line 730 is higher than a predetermined set point due to the line 730 being picked off the seafloor (e.g., see FIG. 8*b* showing its closing cable 855 on seafloor SF), the operator is warned by processor 410 via HMI 415, the navigation lights 1020 (if so equipped) are changed to stop any transiting vessels, and/or the system stops. If the amount of closing line 730 off the closing winch's drum 725 or the amount of opening line 720 on the opening winch 715 is not correct compared to a predetermined set point length, processor 410 informs the operators via HMI 415, changes the navigation lights 1020, and/or the system stops.

When the gate is in the process of opening/closing: If the proper amount of cable is not payed off the closing winch 725 or opening winch 715 (or taken in on the opposite winch) compared to a predetermined set point length, the processor 410 causes the operator to be informed via HMI 415 and/or the system stops. Likewise, if any of the tensions go above their predetermined set points, the operators are informed and/or the system stops. If the line being payed out on one winch does not match the line taken in on other winch, the operator is informed and/or the system stops.

At any time, if tensions in the system's lines approach yield, or other undesirable stresses or tensions are detected, the operator is informed and/or the system is shut down.

All of these notifications can employ the HMI 415, control cabinets, and/or navigation lights 1020, and work together as a system.

Figure 9A:
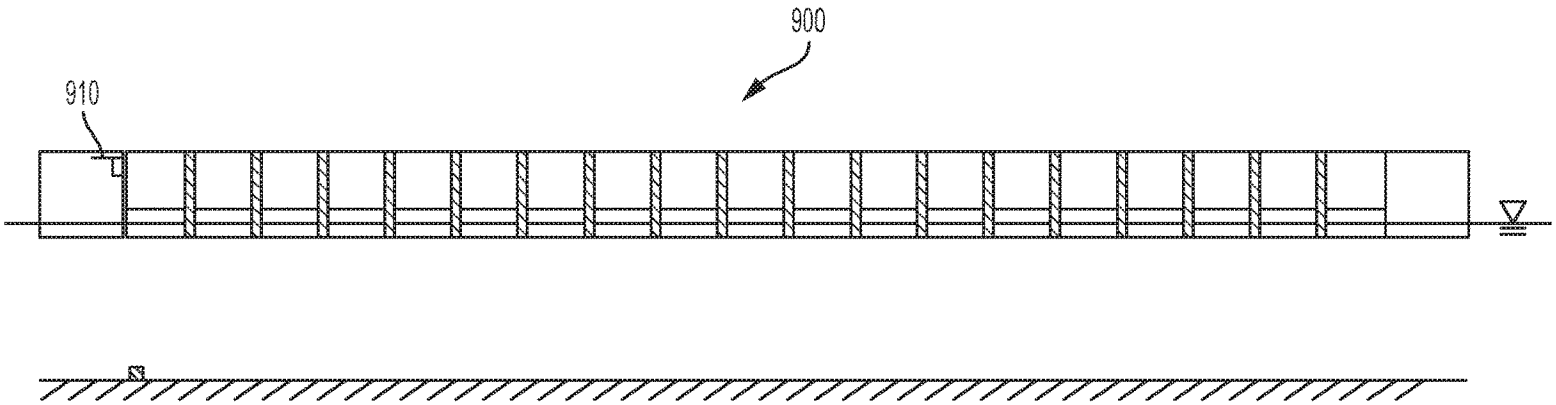
FIGS. 9*a* and 9*b* show side views of a collapsible gate according to a further embodiment of to the present disclosure in closed and open positions, respectively.
Figure 9B:
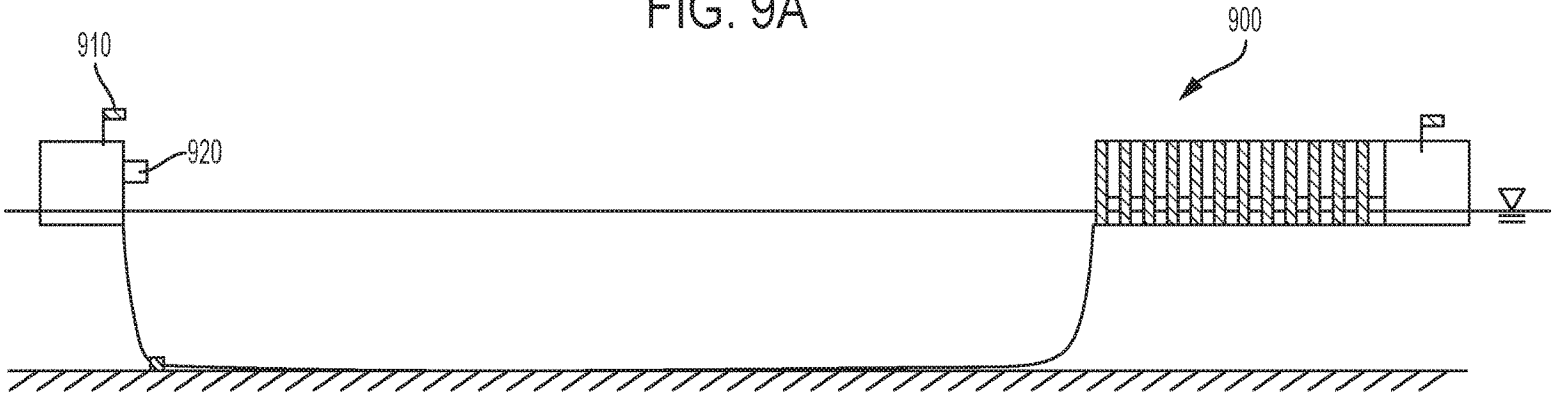

In certain embodiments shown in FIGS. 9*a-b*, the system is outfitted with a mechanical component to indicate that the gate/barrier 900 has been securely fastened. A mechanical, spring loaded flag 910 is arranged so that when its associated latch 920 is breached or opened, a locking pin or the like (not shown) is disengaged, causing the flag 910 to move to an upright and visible position. See FIG. 9*b*. Alternatively, the mechanical indicator may show the opposite; i.e., when the gate is fastened. This mechanical device is operatively connected to the latch mechanism 920 and passively raises or lowers with the actuation of the latch 920, so that operators know if the system is properly secured.

While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

Furthermore, embodiments of the disclosed method and system for automatic gate operation and system status indication for marine barriers and gate systems may be readily implemented, fully or partially, in software using, for example, object or object-oriented software development environments that provide portable source code that can be used on a variety of computer platforms. Alternatively, embodiments of the disclosed method and system can be implemented partially or fully in hardware using, for example, standard logic circuits or a VLSI design. Other hardware or software can be used to implement embodiments depending on the speed and/or efficiency requirements of the systems, the particular function, and/or a particular software or hardware system, microprocessor, or microcomputer system being utilized. Embodiments of the disclosed method and system can be implemented in hardware and/or software using any known or later developed systems or structures, devices and/or software by those of ordinary skill in the applicable art from the functional description provided herein and with a general basic knowledge of the computer, exhaust and fluid flow, and/or cooking appliance arts.

Moreover, embodiments of the disclosed method and system for automatic gate operation and system status indication for marine barriers and gate systems can be implemented in software executed on a programmed general-purpose computer, a special purpose computer, a microprocessor, or the like. Also, the method of this disclosure can be implemented as a program embedded on a personal computer such as a JAVA® or CGI script, as a resource residing on a server or graphics workstation, as a routine embedded in a dedicated processing system, or the like.

What is claimed is:

1. A marine barrier gate system comprising:

a marine gate including a buoyant barrier gate, wherein when the barrier gate is floating in a body of water, it is movable from a closed position where the barrier gate extends from a substantially stationary first attachment point to a substantially stationary second attachment point remote from the first attachment point, to an open position where the barrier gate extends from the first attachment point to a location other than the second attachment point, wherein the first attachment point is attached to a first end of the barrier gate;

an actuator for moving the barrier gate between the open and closed positions;

a sensor operably connected to the actuator to generate data relating to a position of the barrier gate between the open and closed positions; and a controller having a processor for receiving the data from the sensor and processing the data to move the barrier gate between the open and closed positions, and to detect the position of the barrier gate;

wherein the actuator comprises a line attached to the barrier gate for moving the barrier gate by motion of the line, and a rotating hub that rotates with the motion of the line;

wherein the sensor comprises an encoder operably attached to the rotating hub for counting rotations of the hub to generate encoder data; and wherein the processor is for receiving the encoder data and processing the encoder data to detect the position of the barrier gate.

2. The system of claim 1, comprising a human-machine interface operably connected to the processor for communicating the detected position of the barrier gate to a user.

3. The system of claim 2, wherein the line is attached proximal to a free end of the barrier gate opposite the first end of the barrier gate.

4. The system of claim 3, wherein the actuator comprises a winch that includes the rotating hub.

5. The system of claim 3, comprising a sheave or an idler wheel that includes the rotating hub.

6. The system of claim 2, wherein the barrier gate has a variable length, the closed position is a fully expanded position where the barrier gate extends from the first attachment point to the second attachment point, and the open position is a retracted position where the barrier gate extends from the first attachment point to a location between the first and second attachment points;

wherein the actuator includes an opening winch and a closing winch having opening and closing lines respectively, the opening and closing winches located at the first and second attachment points respectively, the opening and closing lines attached proximal to a free end of the barrier gate opposite the first end of the barrier gate, for moving the barrier gate by motion of the respective lines;

wherein the sensor includes a first encoder operably attached to a first rotating hub that rotates with the motion of the opening line, for counting rotations of the first hub to generate first encoder data;

wherein the sensor further includes a second encoder operably attached to a second rotating hub that rotates with the motion of the closing line, for counting rotations of the second hub to generate second encoder data; and wherein the processor is for receiving and processing the first and second encoder data to detect the position of the barrier gate.

7. The system of claim 6, wherein when the processor detects the barrier gate is in the open position, the processor is for operating the closing winch to extend the closing line from the closing winch a predetermined amount based on second encoder data.

8. The system of claim 6, wherein the closing line is connected to the free end of the barrier gate via a releasable latch; and when the processor detects the barrier gate is in the open position, the processor is for operating the latch to release the closing line from the free end of the barrier gate, and operating the closing winch to retract the closing line onto the closing winch a predetermined amount based on second encoder data.

9. The system of claim 6, further comprising a closing line proximity sensor mounted below the surface of the body of water proximal to the bottom of the body of water, for generating a signal when the closing line is proximal to the closing line proximity sensor;

wherein when the processor detects the barrier gate is in the open position, the processor is for operating the closing winch to extend the closing line from the closing winch until the closing line is proximal to the bottom of the body of water, responsive to the signal from the proximity sensor.

10. The system of claim 6, wherein the controller includes a memory; and wherein the processor is for calibrating the system by moving the gate to the open position based on the first and second encoder data or based on input from a user, storing the first and second encoder data as open position data in the memory, moving the gate to the closed position based on updated first and second encoder data corresponding to when the gate is in the closed position or based on input from the user, and storing the updated first and second encoder data as closed position data in the memory.

11. The system of claim 10, further comprising a first end position sensor for generating a closed-gate signal when the barrier gate is in the closed position, and a second end position sensor for generating an opened-gate signal when the barrier gate is in the open position;

wherein the processor is for moving the gate to the open position further based on the opened-gate signal, storing the opened-gate signal as part of the open position data in the memory, moving the gate to the closed position further based on the closed-gate signal, and storing the closed-gate signal as part of the closed position data in the memory.

12. The system of claim 10, wherein the processor is for setting a desired partial open position of the gate by moving the gate to the partial open position based on first and second encoder data corresponding to when the gate is in the partial open position or based on input from the user, and storing the first and second encoder data corresponding to when the gate is in the partial open position as partial open position data in the memory.

13. The system of claim 10, further comprising a closing line proximity sensor mounted below the surface of the body of water proximal to the bottom of the body of water, for generating a signal when the closing line is proximal to the closing line proximity sensor;

wherein when the processor has moved the barrier gate to the open position, the processor is for operating the closing winch to extend the closing line from the closing winch until the signal from the closing line proximity sensor is generated, and storing the closing line proximity sensor signal as part of the open position data in the memory.

14. The system of claim 6, wherein the opening and closing winches each have a load measurement device to measure tension in the opening and closing lines, respectively, and the processor is for receiving data from the load measurement devices and processing the data to control a speed of the gate and the tension in each of the opening and closing lines.

15. The system of claim 14, wherein when the gate is moving from the closed position to the open position by operation of the opening winch, data from the load measurement device of one of the opening and closing winches is used by the processor to control the tension in the opening and closing lines within a predetermined tension range, and data from the load measurement device of the other of the opening and closing winches is used by the processor to control the gate speed within a predetermined speed range.

16. The system of claim 14, wherein the opening and closing winches each comprise an electric motor having a variable-frequency drive;

wherein the processor is for measuring a torque of each respective winch motor using a field-oriented control motor model;

wherein the processor is for controlling the gate speed and line tension based on the torque of each winch motor; and wherein the variable-frequency drive of each winch motor controls the torque of its winch motor responsive to instructions from the processor.

17. The system of claim 14, wherein the opening and closing winches each comprise a hydraulic motor and a motor hydraulic circuit pressure control valve;

wherein the load measurement devices each comprise a monitoring circuit for the hydraulic motor having a pressure transducer for determining a hydraulic pressure consumed by the motor, and the processor is for measuring a torque of a respective winch motor based on the hydraulic pressure;

wherein the processor is for controlling the gate speed and line tension based on the torque of each winch motor; and wherein the motor hydraulic circuit pressure control valve of each winch motor controls the torque of its winch motor responsive to the hydraulic pressure and to instructions from the processor.

18. The system of claim 14, wherein the load measurement devices each comprise a strain gauge or a load pin for measuring the opening and closing line tension.

19. The system of claim 14, wherein the processor is for causing the human-machine interface to inform the user when the tension in one or more of the opening and closing cables exceeds a predetermined set point.

20. The system of claim 19, wherein the processor is for causing the gate to stop moving or for activating a warning light when the tension in one or more of the opening and closing cables exceeds the predetermined set point.

21. The system of claim 6, wherein the first and second encoder data indicate an amount of opening and closing line, respectively, payed off the opening and closing winches; and wherein the processor is for causing the human-machine interface to inform the user when the first or second encoder data indicates the amount of line payed off the opening or closing winch differs from a predetermined set point.

22. The system of claim 21, wherein the processor is for causing the gate to stop moving or for activating a warning light when the first or second encoder data indicates the amount of line payed off the opening or closing winch differs from the predetermined set point.

23. The system of claim 2, further comprising an end position sensor for generating a signal when a free end of the barrier gate opposite the first end of the barrier gate is proximal to the second attachment point, a closing line extendible from the second attachment point, and a closing line sensor mounted below the surface of the body of water for generating a signal when the closing line is proximal to the closing line sensor;

wherein the processor is for receiving the signals from the end position sensor and the closing line sensor;

wherein the processor is for detecting that the gate is in a closed and latched position when the end position sensor senses the free end of the gate is proximal to the second attachment point; and wherein the processor is for detecting that the gate is in an open position and the closing line is extended from the second attachment point when the end position sensor does not sense the free end of the gate and the closing line sensor senses the closing line.

24. The system of claim 23, wherein the end position sensor comprises a first proximity sensor, and the closing line sensor comprises an array of second proximity sensors on the bottom of the body of water.

25. The system of claim 24, wherein the processor is for causing the human-machine interface to inform the user when the gate is in the closed position and the end position sensor no longer senses the free end of the gate is proximal to the second attachment point.

26. The system of claim 2, wherein the sensor comprises a global positioning system (GPS) sensor disposed at a free end of the barrier gate opposite the first end of the barrier gate to generate data relating to the position of the free end of the barrier gate; and wherein the processor is for receiving the GPS sensor data and processing the GPS sensor data to detect the position of the barrier gate.

27. The system of claim 2, comprising a first navigation light attached to a free end of the barrier gate opposite the first end of the barrier gate, a second navigation light attached proximal to the second attachment point, and a plurality of first warning lights disposed along a length of the barrier gate for warning of the presence of the barrier;

wherein the processor is for causing the first and second navigation lights to operate when the gate is in the open position, to indicate it is safe to pass through the gate.

28. The system of claim 27, further comprising a second warning light attached proximal to the second attachment point;

wherein the processor is for causing the second warning light to operate, and for causing the first and second navigation lights to not operate, while the gate is moving or when the processor detects an error, to indicate it is not safe to pass through the gate.

* * * * *